US007377133B2

(12) United States Patent
Sandbach et al.

(10) Patent No.: US 7,377,133 B2
(45) Date of Patent: May 27, 2008

(54) KNITTED SENSOR

(75) Inventors: David Lee Sandbach, London (GB); John Burkitt, Woking (GB); Stuart Mark Walkington, Hertfordshire (GB); Phillipe Georges Crispin, Derbyshire (GB)

(73) Assignee: Peratech Limited, Durham (GB)

( * ) Notice: Subject to any disclaimer, the term of this patent is extended or adjusted under 35 U.S.C. 154(b) by 0 days.

(21) Appl. No.: 10/592,989

(22) PCT Filed: Mar. 17, 2005

(86) PCT No.: PCT/GB2005/001035

§ 371 (c)(1),
(2), (4) Date: Sep. 15, 2006

(87) PCT Pub. No.: WO2005/091319

PCT Pub. Date: Sep. 29, 2005

(65) Prior Publication Data

US 2007/0141939 A1 Jun. 21, 2007

(30) Foreign Application Priority Data

Mar. 18, 2004 (GB) ..... 0406079.4

(51) Int. Cl.
*D04B 1/22* (2006.01)

(52) U.S. Cl. ..... 66/170; 66/202

(58) Field of Classification Search ..... 66/202, 66/169 R, 170

See application file for complete search history.

(56) References Cited

U.S. PATENT DOCUMENTS

| | | | | |
|---|---|---|---|---|
| 4,659,873 | A * | 4/1987 | Gibson et al. | 178/18.05 |
| 6,369,804 | B1 | 4/2002 | Sandbach et al. | |
| 6,452,479 | B1 * | 9/2002 | Sandbach | 338/208 |
| 6,714,117 | B2 * | 3/2004 | Sandbach | 338/101 |
| 7,145,432 | B2 * | 12/2006 | Lussey et al. | 338/47 |
| 2001/0043200 | A1 | 11/2001 | Sandbach | |
| 2002/0096373 | A1 | 7/2002 | Sandbach | |
| 2002/0126100 | A1 | 9/2002 | Sandbach | |
| 2002/0126101 | A1 | 9/2002 | Sandbach | |
| 2002/0180578 | A1 * | 12/2002 | Sandbach | 338/99 |
| 2003/0037966 | A1 | 2/2003 | Sandbach | |

FOREIGN PATENT DOCUMENTS

| | | |
|---|---|---|
| DE | 3805887 C1 | 9/1989 |
| EP | 0989509 A | 3/2000 |
| GB | 2341933 | 3/2000 |
| GB | 2350683 | 12/2000 |
| GB | 2365134 | 2/2002 |

* cited by examiner

*Primary Examiner*—Danny Worrell
(74) *Attorney, Agent, or Firm*—Harness, Dickey & Pierce, P.L.C.

(57) ABSTRACT

A sensor having a three layer construction comprising a first knitted conductive textile plane, a second conductive textile plane and an intermediate separating plane penetrable by the first knitted conductive textile plane to allow the first conductive textile plane and the second conductive textile plane to make electrical contact under a mechanical interaction. The intermediate separating plane defines structural endpoints from which the first knitted conductive textile plane deforms towards the second conductive textile plane under a mechanical interaction. The first knitted conductive textile plane has conductive yarn knitted to form a repeating pattern of stitches each comprising a stitch looping portion SLP having a looping portion footprint LPF. Within the sensor, there is at least one of a plurality of described dimensional relationships between stitches of the first knitted conductive textile plane and structural endpoints of the intermediate separating plane.

8 Claims, 20 Drawing Sheets

KNITTED SENSOR

BACKGROUND OF THE INVENTION

1. Field of the Invention

The present invention relates to improving the uniformity of the response of a sensor to a mechanical interaction, in particular to improving the uniformity of the sensitivity of a sensor having at least one conductive textile knitted layer.

2. Description of the Related Art

In many applications of manually operable touch sensors, the sensor is required to be flexible and sensitive to applied pressure within predetermined tolerances. A type of fabric touch sensor having a three layer construction comprises two outer conductive textile layers and a central separator layer defining a plurality of apertures. The separator layer is configured to space the conductive textile layers apart when no pressure is applied to the sensor, and to allow electrical contact between the layers under a mechanical interaction.

A problem with this type of textile sensor is that the frequency of undesirable triggering of the sensor may be unacceptable for some applications. Undesirable triggering may be caused by bending or flexing of the sensor, or by internal forces within the sensor arising from deviations from the sensor pattern during manufacture, creases or other set within one or more layers accrued during manufacture or use of the sensor.

US patent publication U.S. Pat. No. 4,659,873 discloses a textile sensor comprising two outer conductive textile layers and a central insulating separator layer, in which the layers are stretched across a frame such that the layers are held flat across the apertures of the separator layer. This arrangement is not suitable for applications of touch sensors in which flexibility is required, and the frame may impart unacceptable variations in sensitivity to mechanical interactions at different locations across the sensing area.

International patent publication WO 00/072239 describes a type of textile sensor constructed from five layers, which provides improved sensitivity and resistance to undesirable triggering. The cost of production of this more complex sensor, however, is considered to diminish the viable range of applications of the sensor.

It is thus desirable to provide a sensor that is flexible, displays uniform sensitivity and is economical to manufacture.

BRIEF SUMMARY OF THE INVENTION

According to an aspect of the present invention, there is provided a sensor comprising: a first knitted conductive textile plane, a second conductive textile plane, and an intermediate separating plane penetrable by the first knitted conductive textile plane to allow the first conductive textile plane and the second conductive textile plane to make electrical contact under a mechanical interaction; the intermediate separating plane defines the structural perimeter of each of a plurality of apertures from which the first knitted conductive textile plane deforms towards the second conductive textile plane under a mechanical interaction; wherein: the first knitted conductive textile plane has conductive yarn knitted to form a repeating pattern of stitches each comprising a stitch looping portion SLP having a looping portion footprint LPF, the separating plane defines apertures A having an aperture footprint AF, and at least one looping portion footprint LPF is wholly containable within at least one aperture footprint AF.

According to an aspect of the present invention, there is provided a sensor comprising: a first knitted conductive textile plane, a second conductive textile plane, and an intermediate separating plane penetrable by the first knitted conductive textile plane to allow the first conductive textile plane and the second conductive textile plane to make electrical contact under a mechanical interaction; the intermediate separating plane defines structural endpoints extending towards the first conductive textile layer that are boundary vertices of a virtual polygonal aperture window and from which the first knitted conductive textile plane deforms towards the second conductive textile plane under a mechanical interaction; wherein: the first knitted conductive textile plane has conductive yarn knitted to form a repeating pattern of stitches each comprising a stitch looping portion SLP having a looping portion footprint LPF, the separating plane defines virtual polygonal aperture windows AW having an aperture window footprint AWF, and at least one looping portion footprint LPF is wholly containable within at least one aperture window footprint AWF.

WRITTEN DESCRIPTION OF THE BEST MODE FOR CARRYING OUT THE INVENTION

FIG. 1

Figure 1:
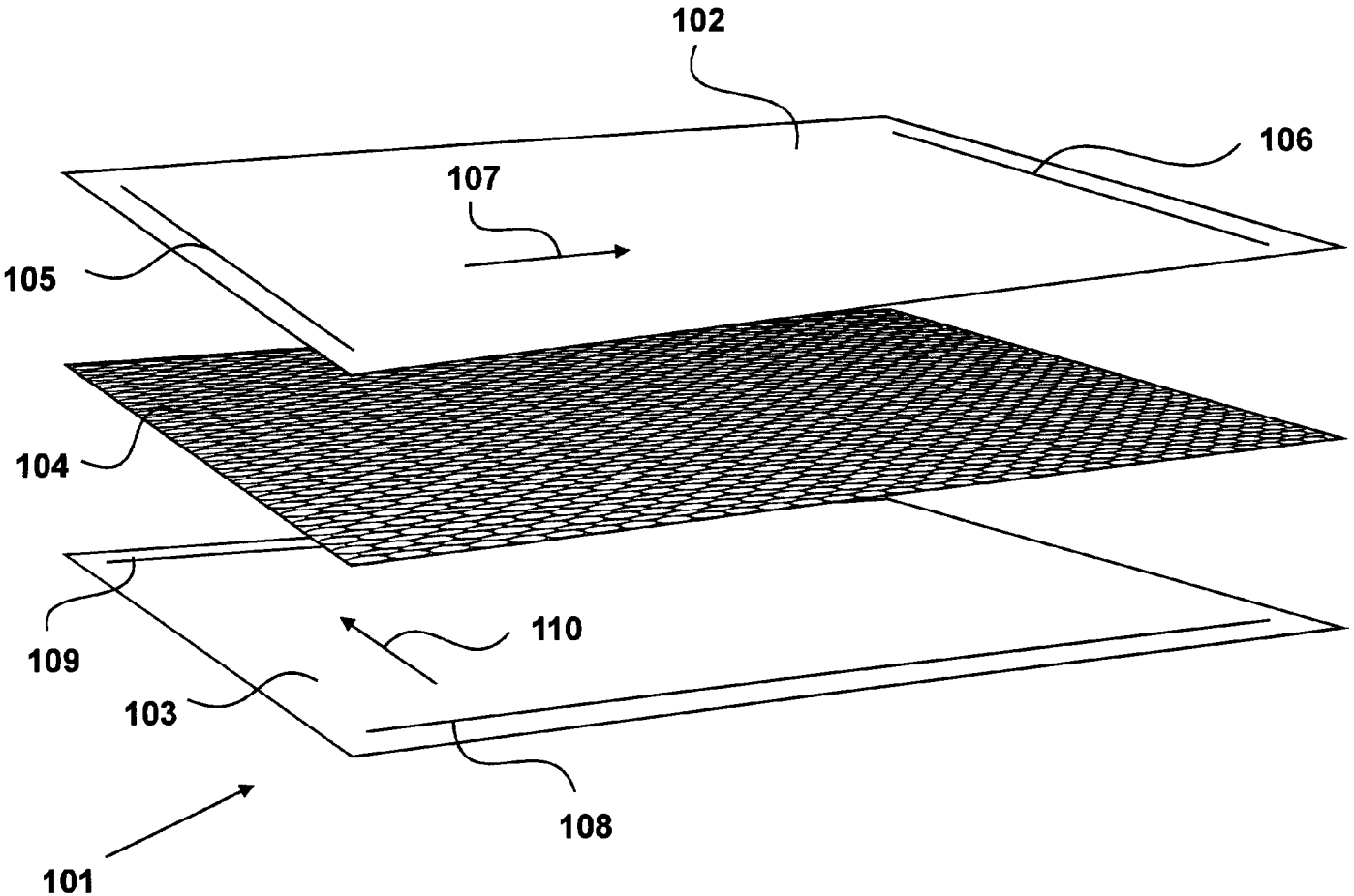
FIG. 1 shows an exploded view of a position sensor.

An exploded view of a position sensor is shown in FIG. 1. Sensor 101 utilises a three layer construction including a first electrically conducting layer 102, a second electrically conducting layer 103 and an intermediate separating layer 104, in this example a mesh fabricated from electrically insulating material, disposed between the two conductive textile layers 102, 103.

The electrically conducting layers are preferably in the form of fabrics machined from a mixture of electrically conducting fibres and insulating fibres. An example of a fabric of this type is disclosed in International Patent Publication No. WO 00/72240.

First electrically conducting layer 102 is provided with a first pair of conducting members 105, 106, with one extending along each edge of a first pair of opposed edges of the layer. In response to an electrical potential applied between these conducting members 105, 106 electrical current may flow across first layer 102 in a direction indicated by arrow 107.

Similarly, second electrically conducting layer 103 is provided with a second pair of conducting members 108, 109, with one extending along each edge of a second pair of opposed edges of the layer. In response to an electrical potential applied between these conducting members 108, 109 electrical current may flow across second layer 103 in a direction indicated by arrow 110.

In sensor 101, the second pair of opposed edges of second layer 103 is the opposite pair to the first pair of opposed edges of the first layer 102. Thus, two electrical currents running in perpendicular directions may be generated within sensor 101.

As described in European Patent Publication No. EP 0 989 509, this electrical arrangement allows the sensor to detect both the position of a mechanical interaction within the sensing area (X-axis and Y-axis data) and an additional property of the mechanical interaction, for example the extent or pressure of the mechanical interaction (Z-axis data).

FIG. 2

Figure 2:
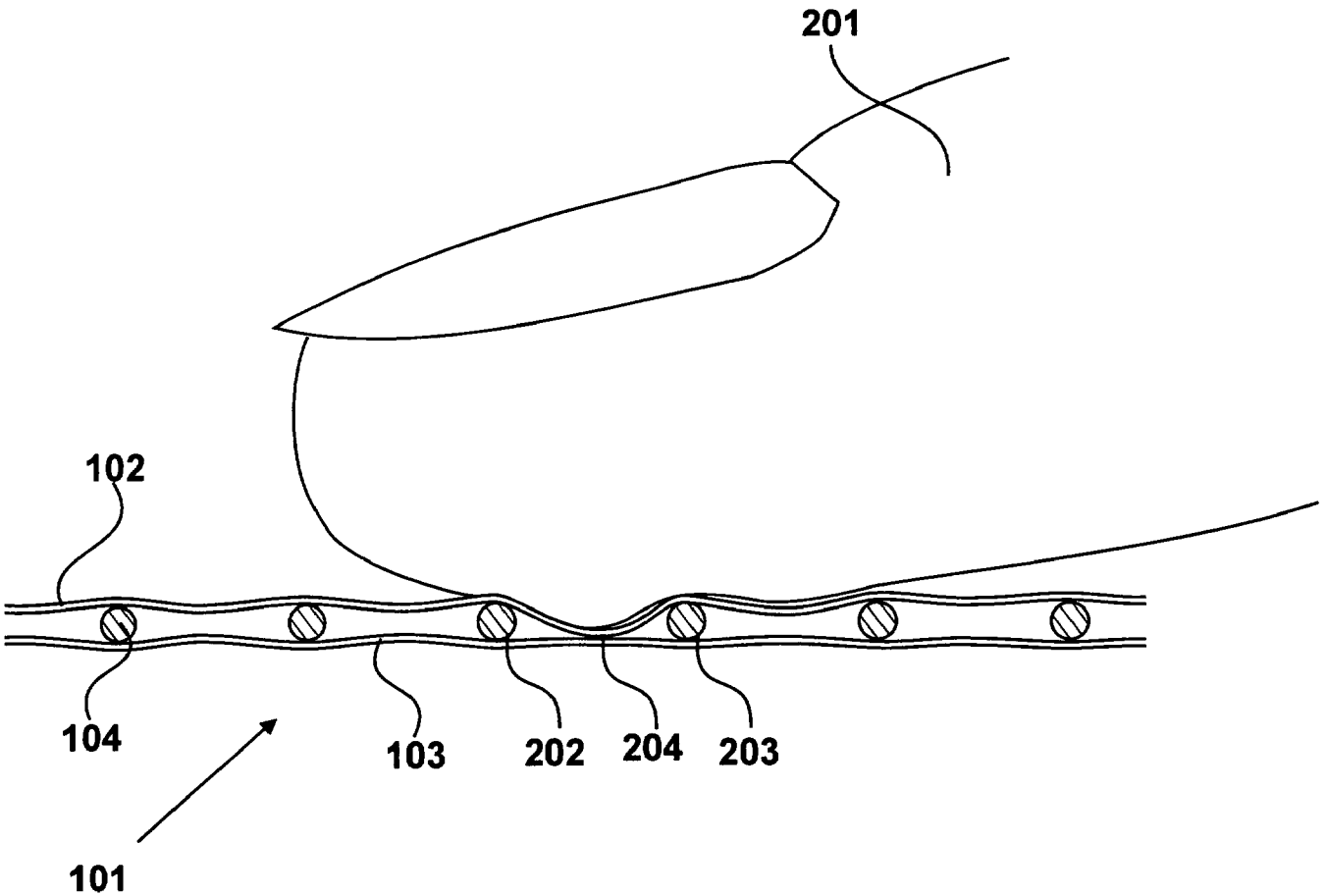
FIG. 2 shows a cross section of the sensor of FIG. 1.

A cross section of sensor 101 is shown in FIG. 2. Each electrically conducting layer 102, 103 is a conductive textile layer having associated compliance and undulate characteristics.

It can be seen that where no pressure is applied to sensor 101, the upper first electrically conducting layer 102 is spaced from the second electrically conducting layer 103 by the intermediate separating layer 104.

FIG. 2 shows a mechanical interaction under manually applied pressure, at a position between supporting portion 202 and neighbouring supporting portion 203 of the intermediate separating layer 104. Under the action of finger 201 pressing on the first conducting layer 102, the first conducting layer 102 is brought into contact with the second conducting layer 103. Thus, where pressure is applied, the conducting layers 102, 103 are brought together to make electrical contact, as illustrated at location 204, and in this way a conductive path through the sensor 101 is formed.

A characteristic of this type of sensor is that the response to applied pressure is dependent upon the compliance of the actuator applying the pressure. The actuator should be sufficiently compliant in the Z-axis to locally deform a conductive layer into an aperture of the separator layer. In practice if the actuator is pointed, the applied pressure may result in only a single contact with the fabric being forced into one aperture only. Alternatively pressure is applied over a broader area, resulting in multiple contacts through multiple holes in the intermediate separating layer. An actuator having a hard, flat surface requires a greater degree of force to be used to establish an electrical contact than an actuator having a soft, compliant surface. This property may be modified by the incorporation of an additional layer, on top or underneath the sensor, which is compliant in the Z-axis. The additional layer may be a fabric or a foam layer.

FIG. 3

Figure 3:
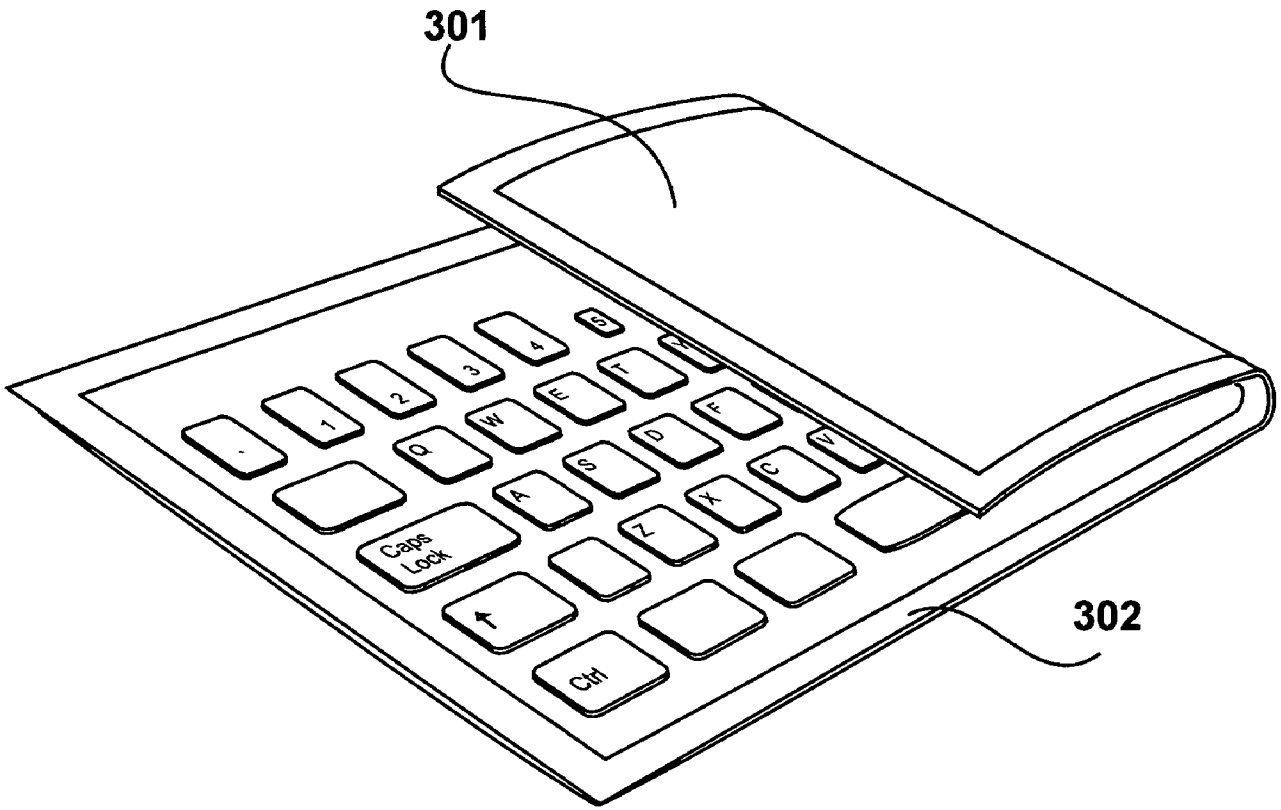
FIG. 3 shows a flexible detector.

A three layer construction in which each layer is bendable can be utilised to form a flexible sensor. Flexible position detector 301 of FIG. 3 utilises such a construction and is provided with a cover outlining keys of a keypad. The layers of the flexible detector 301 are held together around the perimeter of the detector 301, within margin 302. Flexible detector 301 as a whole is bendable, and may be folded as illustrated.

The response of detector 301 to a mechanical interaction depends on factors relating to the production sensitivity of the detector 301, the presence of set within the layers of the detector 301 and the position of a mechanical interaction within the sensing area of the detector 301.

The production sensitivity of a sensor is the general inherent sensitivity to which the sensor is manufactured. It is to be appreciated that detector 301 is required to trigger under manually applied pressure but is not to be so sensitive as to trigger when no deliberate press on the detector 301 is made.

Flexible sensors can be prone to undesirable triggering. Undesirable triggering may arise from internal forces within the sensor that are introduced during manufacture, for example deviations from the sensor pattern during manufacture may result in misalignment of layers or the occurrence of creases or puckering within the layers. Undesirable triggering of a sensor may also arise from internal forces within the sensor accrued by use of the sensor, for example from bending or flexing of the sensor, or from general wear and tear.

It is to be appreciated that naturally occurring variations within the construction materials can also affect sensor performance and cause natural discrepancies in the response of the sensor.

Variations within the sensor construction can affect the compliance of the layers across the sensing area. In some cases, gradients in tensile forces across the layers of a sensor may render mechanical interactions at some locations less distinguishable than mechanical interactions at other locations. For example, looking at detector 301, it may be found that mechanical interactions closer to the margin 302 are less distinguishable than mechanical interactions at more central locations.

Another factor that may bring about variations in trigger response is the electrical arrangement utilised to effect sensing. For example, the relative position of a mechanical interaction with respect to one or more conducting members may determine how detectable to the sensor the mechanical interaction is. Thus, it can be found that the response of a sensor to the same applied pressure varies according to the location at which the pressure is applied.

It is desirable to improve the uniformity of response of individual sensors and, in particular from a commercial perspective, to improve the uniformity of response between like sensors. It is therefore desirable to "smooth out" unavoidable variations in sensor sensitivity.

FIG. 4

The production sensitivity to which sensors are manufactured is based on a production tolerance, which provides a measure of the activation force of a sensor, applicable across the entire sensing area. Production tolerances function to facilitate selection of an appropriate sensor for a particular application and also to facilitate quality control.

The production tolerance of a sensor may define a lower threshold force which when applied to the sensor will not trigger an output, and an upper threshold force which when applied to the sensor will trigger an output. These lower and upper force thresholds thus provide two indicators of the sensitivity of the sensor. Optimum uniformity of sensitivity and perceived quality of performance is obtained when upper and lower thresholds are closest together.

A production tolerance may be presented in the form A±B, where A is a nominal activation force and B is a tolerance parameter. As a first example, the production tolerance of a mechanical keyboard may be provided as 50 g±10 g. This indicates that the keyboard has a nominal activation force of 50 g, that none of the keys will activate under an applied force of 40 g and that every key will activate under an applied force of 60 g. As a second example, the production tolerance of a sensor may be provided as 50 g −25 g and +100 g. This indicates that the keyboard has a nominal activation force of 50 g, that the sensor will not activate under a force of 25 g applied anywhere in the sensing area and that the sensor will activate each time a force of 150 g is applied anywhere in the sensing area.

It is to be appreciated that, according to the application of a sensor, conformity of the sensor to one of the upper or lower force thresholds may be more important than to the other. For example, considering flexible detector 301 of FIG. 3, conformity to the lower activation threshold is of primary importance if undesirable triggering is to be avoided.

Figure 4:
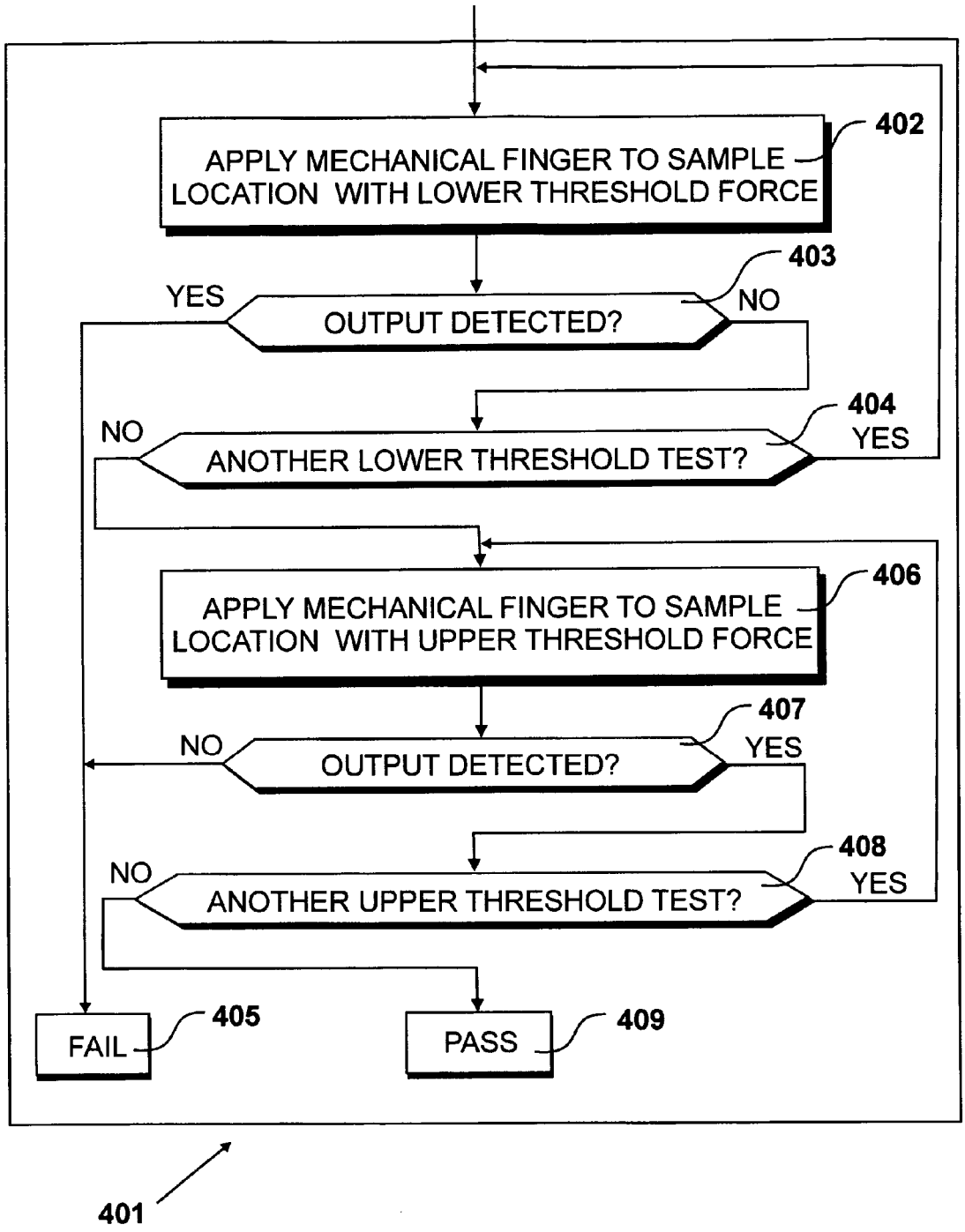
FIG. 4 illustrates steps in a sensor test routine.

FIG. 4 shows a flow chart 401 illustrating steps in a routine for testing whether a sensor conforms to a predetermined production tolerance. The routine first tests for sensor conformity to a lower threshold force before testing conformity to an upper threshold force.

At step 402, a mechanical finger, or prodder, is used to apply a force of the magnitude of the lower threshold force at a sample location within the sensing area of the sensor. At step 403 a question is asked as to whether an output from the sensor is detected. If the question asked at step 403 is answered in the negative, indicating conformity with the lower threshold force, step 404 is entered. Alternatively, if the question asked at step 403 is answered in the affirmative, indicating nonconformity with the lower threshold force, step 405 is entered where the sensor is deemed to have failed the test routine.

At step 404, a question is asked as to whether another lower threshold force test at a different sample location is to be performed. If the question asked at step 404 is answered in the affirmative, indicating that another test is to be performed, control returns to step 402. Alternatively, if the question asked at step 404 is answered in the negative, indicating that tests at the lower threshold force at all the sample locations to be tested have been determined as successful, step 406 is entered.

At step 406, a mechanical finger or prodder, whether the same as that used at step 402 or not, is used to apply a force of the magnitude of the upper threshold force at a sample location within the sensing area of the sensor. At step 407 a question is asked as to whether an output from the sensor is detected. If the question asked at step 403 is answered in the affirmative, indicating conformity with the upper threshold force, step 408 is entered. Alternatively, if the question asked at step 407 is answered in the negative, indicating nonconformity with the upper threshold force, step 404 is entered where the sensor is deemed to have failed the test routine.

At step 408, a question is asked as to whether another upper threshold force test at a different sample location is to be performed. If the question asked at step 408 is answered in the affirmative, indicating that another test is to be performed, control returns to step 406. Alternatively, if the question asked at step 408 is answered in the negative, indicating that tests at the upper threshold force at all the sample locations to be tested have been determined as successful, step 409 is entered, where the sensor is deemed to have passed the test routine.

FIG. 5

Figure 5:
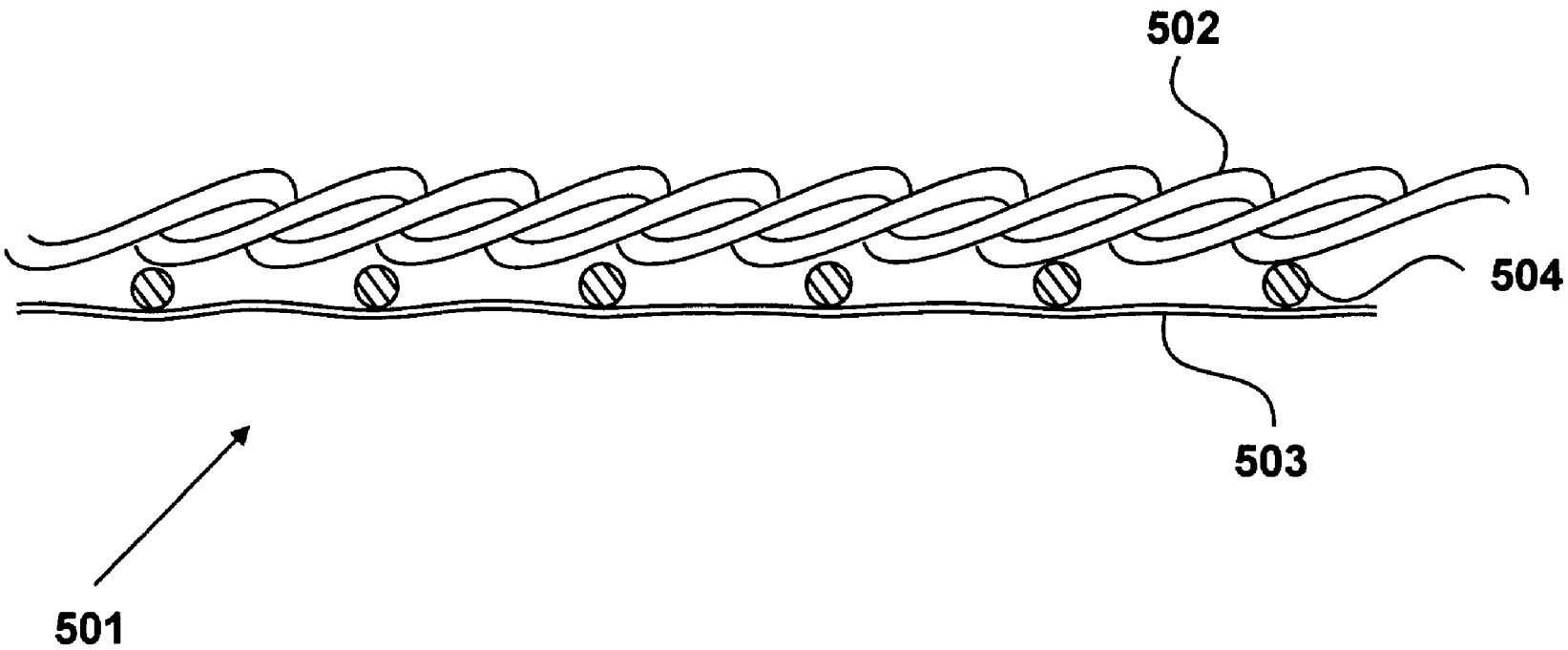
FIG. 5 shows a sensor constructed from three layers.

FIG. 5 shows a cross-section of a sensor embodying the present invention, utilising a first knitted conductive textile plane, a second conductive textile plane and an intermediate separating plane in its construction.

Sensor 501 is constructed from three layers only, a first knitted conductive textile layer 502, a second conductive textile layer 503 and an intermediate separating layer 504 disposed between the first and second conductive textile layers. The intermediate separating layer 504 is penetrable by the first knitted conductive textile plane to allow the first conductive textile plane and the second conductive textile plane to make electrical contact under a mechanical interaction. Thus, according to the construction of sensor 501, the first knitted conductive textile plane, the second conductive textile plane and the intermediate separating plane utilised are each provided by a separate layer. In a first alternative construction, the intermediate separator plane and an outer conductive textile plane are provided in a first separate layer structure with the other outer conductive textile plane provided by a second separate layer structure. In a second alternative construction, the intermediate separator plane and both outer conductive textile planes are provided in a single separate layer structure.

Knitted conductive textile layer 502 is fabricated with a degree of compliance imparting to the fabric the ability to be forced through apertures in the intermediate separating layer 504 to make electrical contact with the second conductive textile layer 503. According to the construction of sensor 501, second conductive textile layer 503 is also fabricated with a degree of compliance imparting to the fabric a similar ability, however in other embodiments this feature of the second conductive textile layer may not be provided.

Knitted conductive textile layer 502 includes conductive yarn knitted throughout the plane, allowing the fabric to extend in the direction of the plane and/or in the direction perpendicular to the plane. The first knitted conductive textile layer 502 may be constructed according to a warp knit pattern or a weft knit pattern.

Second conductive textile layer 503 includes conductive fibres and may be constructed according to a knit, weave or felt pattern. Woven fabrics have good conductive properties but do not tend to stretch or compress significantly; some woven textiles are not extensible in the lateral direction.

FIG. 6

Figure 6:
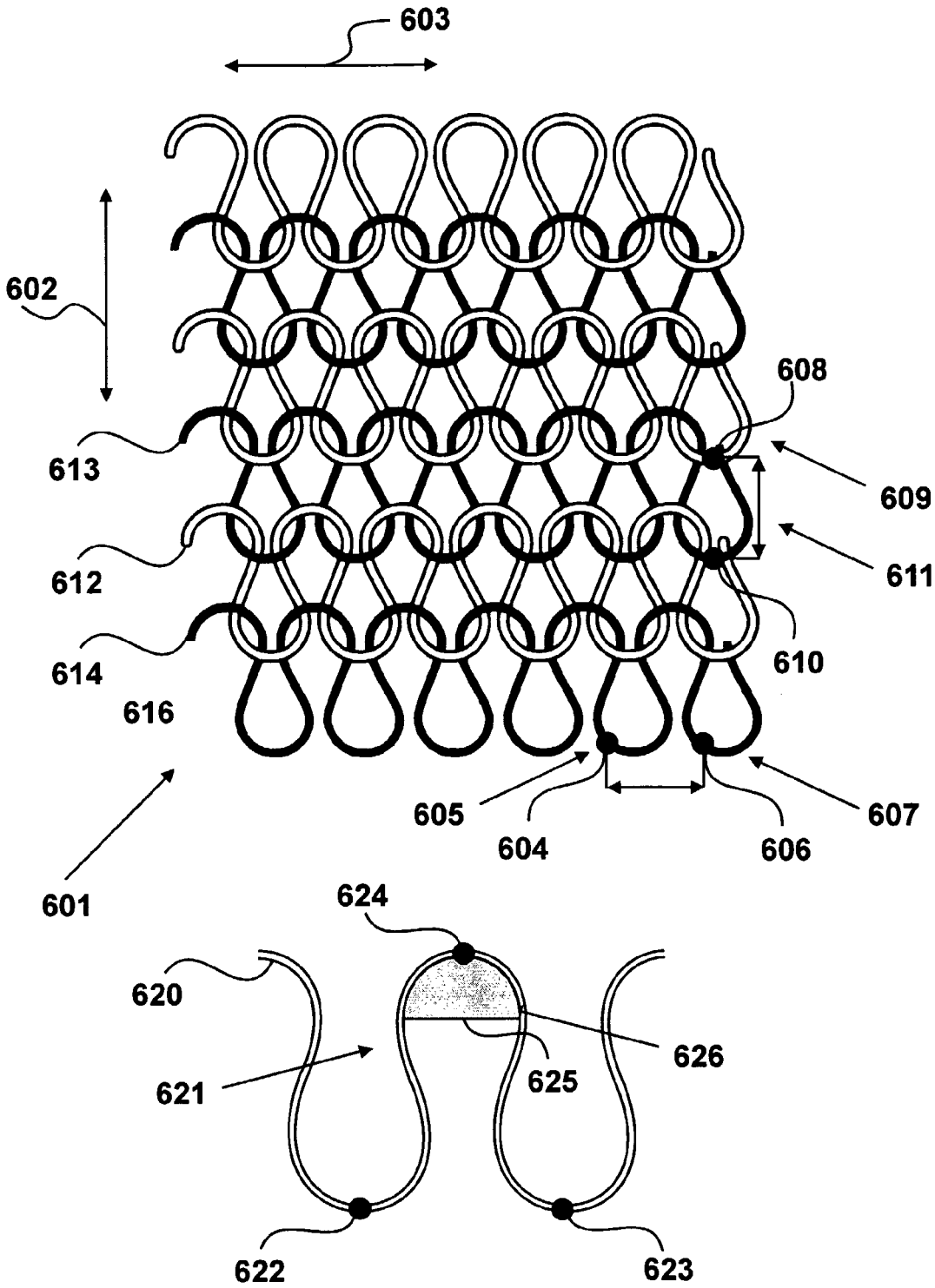
FIG. 6 shows a weft knit.

A textile having a weft knit construction is illustrated in FIG. 6.

Knitting is the technique of constructing fabric by interlacing yarn to form loops and loops within loops. The unit of a knit fabric is the loop or stitch; a stitch is formed when a yarn is pulled through a previous loop.

In the textile industry, the term courses is used to refer to stitches in a row lengthways down a knit and the term wales is used to refer to stitches in a row across the knit.

Looking at textile 601, courses extend in the direction indicated by arrow 602 and wales extend in the direction indicated by arrow 603. Typically, a weft knitted fabric has a ratio between the courses and wales that is equal to up to 50% more courses than wales.

Stitch dimensions are derived from measuring the distance between a nominated point of a stitch and the corresponding point of an adjacent stitch; thus measurements along the courses and wales of a knit indicate the stitch pitch in the length and width directions.

Looking at textile 601, the stitch width is the distance between point 604 of stitch 605 and point 606 of adjacent stitch 607; stitch width is thus measured along a wale. The stitch length of textile 601 is the distance between point 608 of stitch 609 and point 610 of adjacent stitch 611; stitch length is thus measured along a course.

Other dimensions of a knit fabric include wale stitch repeat pitch and course stitch repeat pitch, which are typically measured by counting the number of repeats across a predetermined distance, typically 1" (one inch imperial)/2.54 cm.

It can be seen that each yarn of the weft knit construction of textile 601 intertwines with another yarn, forming overlapping portions that protrude in the z-axis from either the lower surface or the upper surface of the fabric. For example, yarn 612 intertwines with yarn 613 and yarn 614, forming looping portions.

A looping portion of a yarn 620 of a knit is shown at 621. Looping portion 621 is a portion of yarn within the knit where the yarn changes direction through at least 180 degrees. It can be seen that the path of the yarn in looping portion 621, between point 622 and point 623 is repeated in the wale direction. It can also be seen that points 622, 623 and 624 are all located at consecutive turning points along the curvature of the yarn, forming the wales.

The loop width is measured as the maximum distance across the looping portion. This is the maximum chord of the loop, indicated on looping portion 621 by line 625. The segment of the loop above this line, indicated by arrow 626, is herein referred to as the looping portion footprint LPF.

FIG. 7

Figure 7:
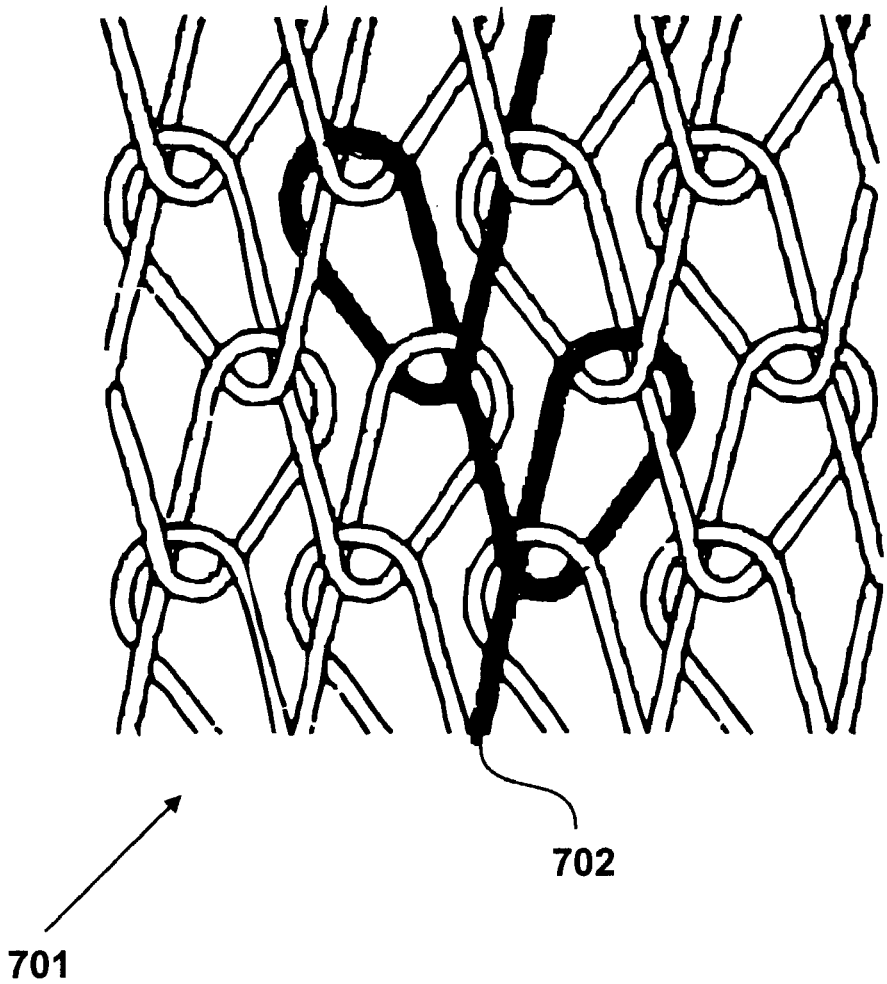
FIG. 7 shows a warp knit.
Figure 7:
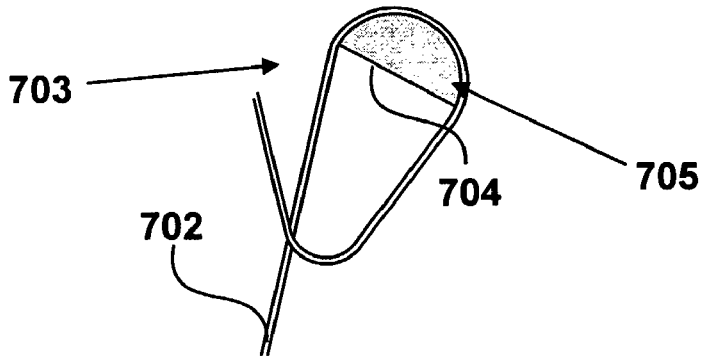

A textile having a warp knit construction is illustrated in FIG. 7. The construction of textile 701 also comprises looping portions. A looping portion of yarn 702 of the knit of textile 701 is shown at 703. The loop width is measured as the maximum distance across the looping portion. The maximum chord of the loop, the length of which is the loop width, is indicated by line 704. The looping portion footprint LPF of the loop, this being the area of the segment of the loop above line 704, is indicated by arrow 705.

It is to be appreciated that the shape, size and orientation of a looping portion, the degree to which a looping portion protrudes and the surface of the textile from which a looping portion protrudes is dependent upon the specific fabric knit construction.

Preferably, the first knitted conductive textile layer of a sensor embodying the present invention takes the form of a very fine warp knit. A pitch between stitches of between 0.1 mm and 0.3 mm provides a smooth uniform surface, generally free from bumps and lumps. The construction of the layer may comprise all electrically conductive yarn or a mixture of electrically conductive yarn and electrically insulating yarn. Preferably, the warp knit construction incorporates a substantially equal mix of electrically conducting yarns with electrically insulating yarns.

FIG. 8

The intermediate separator layer 504 of sensor 501 may be provided by a textile structure or a mesh structure.

Figure 8:
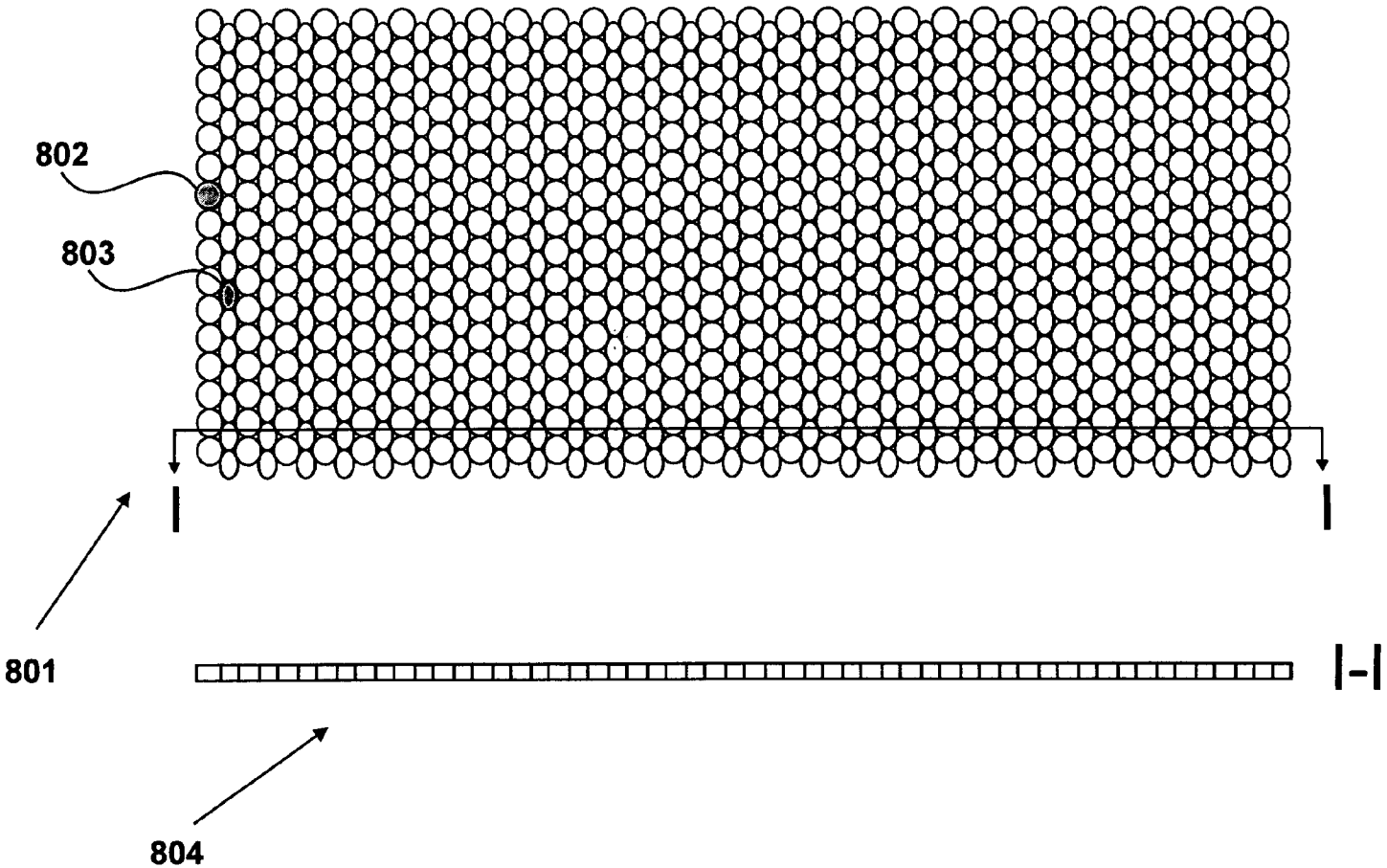
FIG. 8 shows a mesh.

FIG. 8 shows a knitted textile structure 801. Textile structure 801 defines a plurality of apertures according to a regular pattern. According to the pattern of textile structure 801, two types of aperture are defined, a first type, such as aperture 802, having a substantially circular shape and a second type, such as aperture 803, having a substantially elliptical shape. The aperture footprint AF of aperture 802 is the area of the aperture, which is shown shaded; in this example the area interior of the structural boundary of the aperture as defined by the mesh. In this example, the aperture footprint AF of aperture 802 is the same shape as the aperture 802. The aperture footprint AF of aperture 803 is also shown shaded in FIG. 8. A section through the textile structure 801 along line I-I is shown at 804.

In order to be sensitive to manual interaction, a detector must be sensitive to relatively low pressures. It is found that the average finger would cover an area of 100 $mm^2$ and that for most applications of manually operable sensor a user would be comfortable when applying a force of 0.5 Newton to 1 Newton, resulting in an applied pressure of 5 kPa to 10 kPa.

Properties of a mesh that effect performance of a sensor are hole dimension and mesh thickness. The sensitivity of a sensor may be varied by changing the aperture size and/or thickness of the separator layer.

It has been found that it is not the absolute mesh thickness or the absolute hole area that determines the properties of the detector, it is the ratio between these two quantities and the physical interaction between mesh and conductive layers. Therefore, for the purposes of this disclosure, a mesh density parameter may be defined as the mesh thickness divided by the effective hole area.

The hole size of the mesh should be sufficient to allow yarns in the conductive textile layers to make electrical contact through the mesh, and when selecting a mesh, the type and diameter of yarn in the textile conductive layers should be considered. In addition, within the sensor, the alignment of looping portions of the knitted conductive textile layer relative to supporting portions of the intermediate separating layer can cause regions of differing sensitivity across the sensing area of the detector.

Position detectors are known that have been found to be susceptible to false triggering and that utilise a thin mesh having a thickness of 0.09 mm and an average hole area of 3.8 $mm^2$. This provides a mesh with a mesh density of 0.23, requiring a trigger pressure of 10 kPa.

Alternative types of mesh include meshes that define a plurality of apertures having a regular or irregular shape according to an irregular pattern and meshes that define a plurality of apertures according to a pattern that includes only one or more than two types of aperture.

FIG. 9

Figure 9:
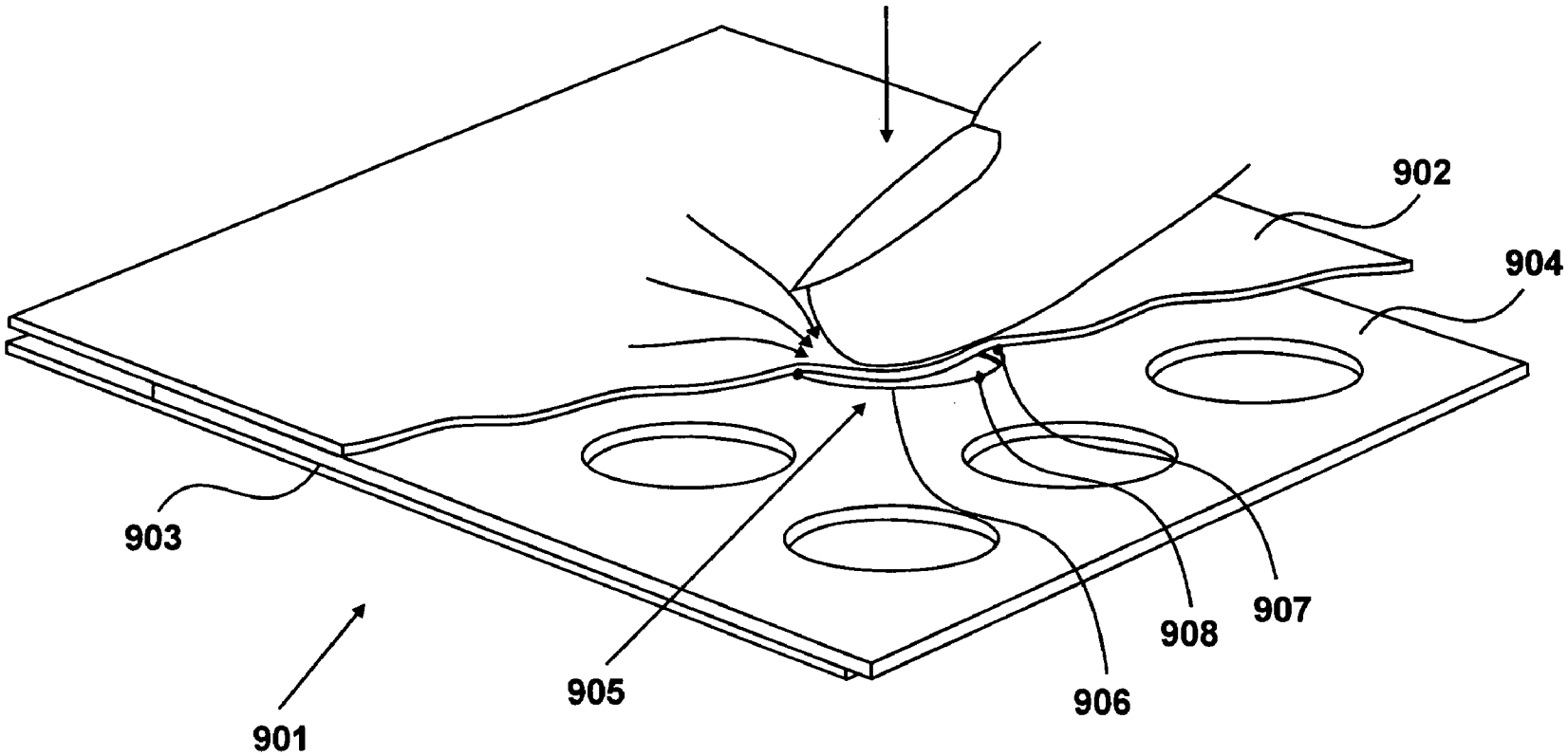
FIG. 9 shows deformation of a layer of a sensor.

FIG. 9 illustrates deformation of a layer of a sensor 901 constructed from a first conductive knitted textile layer 902, a second conductive textile layer 903 and an intermediate separating mesh 904 only, during a mechanical interaction. Intermediate separating mesh 904 defines a substantially circular aperture 905 having a structural perimeter 906.

As shown, when pressure is applied to the first conductive knitted textile layer 902 at a location above an aperture defined by the intermediate separating mesh 904, the first conductive knitted textile layer 902 gathers up and deforms into the aperture towards the second conductive textile layer 903. It can be seen that the first conductive knitted textile layer 902 deforms into the aperture from structural endpoints, around the structural perimeter of the aperture, such as structural endpoints 907 and 908 of the structural perimeter 906 of aperture 905. This deformation is facilitated by the compliance of the layer allowing the fabric to extend in the direction of the plane and/or in the direction perpendicular to the plane.

FIG. 10

Figure 10:
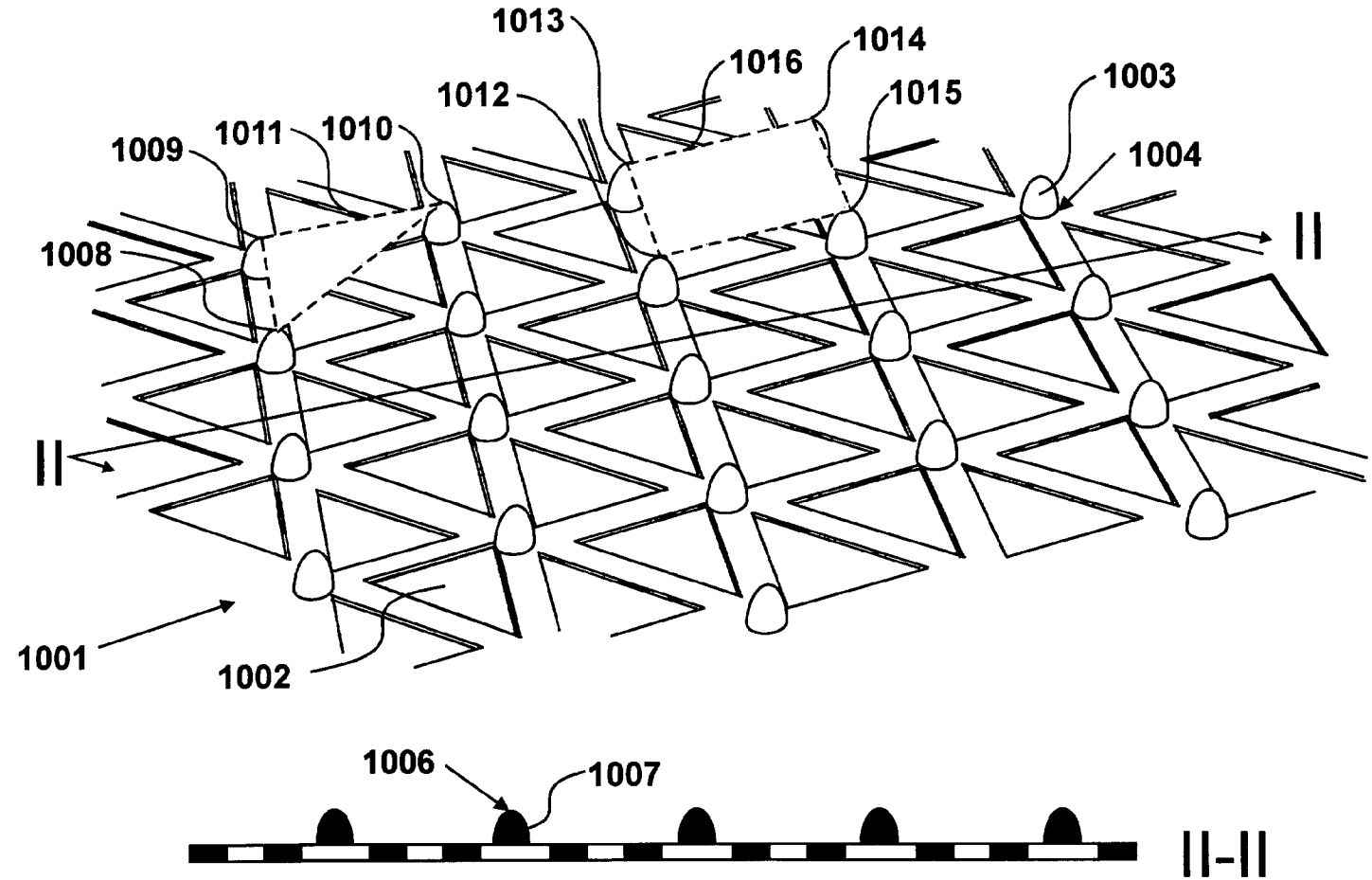
FIG. 10 shows a mesh having extension portions.

FIG. 10 illustrates a mesh that has extension portions. Mesh 1001 defines apertures, such as aperture 1002, each having a substantially triangular shape. The aperture footprint AF of aperture 1002 is the area of the aperture, which is shown shaded; in this example the area interior of the structural boundary of the aperture as defined by the mesh. In this example, the aperture footprint AF of aperture 1002 is the same shape as the aperture 1002. As shown, mesh 1001 defines a repeating pattern of apertures.

Mesh 1001 has a plurality of extension portions, such as extension portion 1003, extending from extension positions 1004 upon the mesh. According to the pattern of mesh 1001, the extension portions occur at positions of mesh intersection. In this example, mesh 1001 is provided with extension portions in accordance with a repeating pattern. In addition, all the extension portions of mesh 1001 extend from the same surface of the mesh 1001.

A section through the mesh 1001 along line II-II is shown at 1005. The upstanding extension portions of mesh 1001 each have a substantially half egg-shape. Each extension portion has a structural endpoint at the apex thereof, such as structural endpoint 1006 of extension portion 1007.

The structural endpoints of extension portions of a mesh form boundary vertices of a virtual polygonal aperture window. For example, endpoints 1008, 1009 and 1010 are boundary vertices of a triangular virtual aperture window, indicated by shaded area 1011, and endpoints 1012, 1013, 1014 and 1015 are boundary vertices of a rectangular virtual aperture window, indicated by shaded area 1016.

Alternative types of mesh with extension portions include meshes that define a plurality of apertures according to a pattern that includes more than one type of aperture, meshes that have a plurality of extension portions according to a pattern that includes more than one type of extension portion and meshes that have extension portions at locations other than mesh intersections.

A mesh of this type, having extension portions included thereon, is available from Applied Extrusion Technologies Limited, Bristol, England. The extension portions are referred to as bosses and the material may be defined in terms of the mesh thickness and the boss count.

An example of an appropriate product is sold under the trademark Delnet X550. This is fabricated from an extruded and embossed high density polyethylene. The material has a weight of 12 gms per square metre and a thickness of 0.11 mm. Typically it has a boss count of 8.3 in a first direction and 9.4 per cm in an orthogonal direction.

An alternative product is sold under the trademark Delnet X220. Again, the material is extruded and embossed from high density polyethylene and has a weight of 27 gms per square meter. It is 0.26 mm thick and has a boss count of 4.3 per cm length.

An alternative material is sold under the trademark Delnet X215. The material is of similar construction having a weight of 34 gms per square meter, a thickness of 0.25 mm and a boss count of 5.5 per linear cm.

FIG. 11

Figure 11:
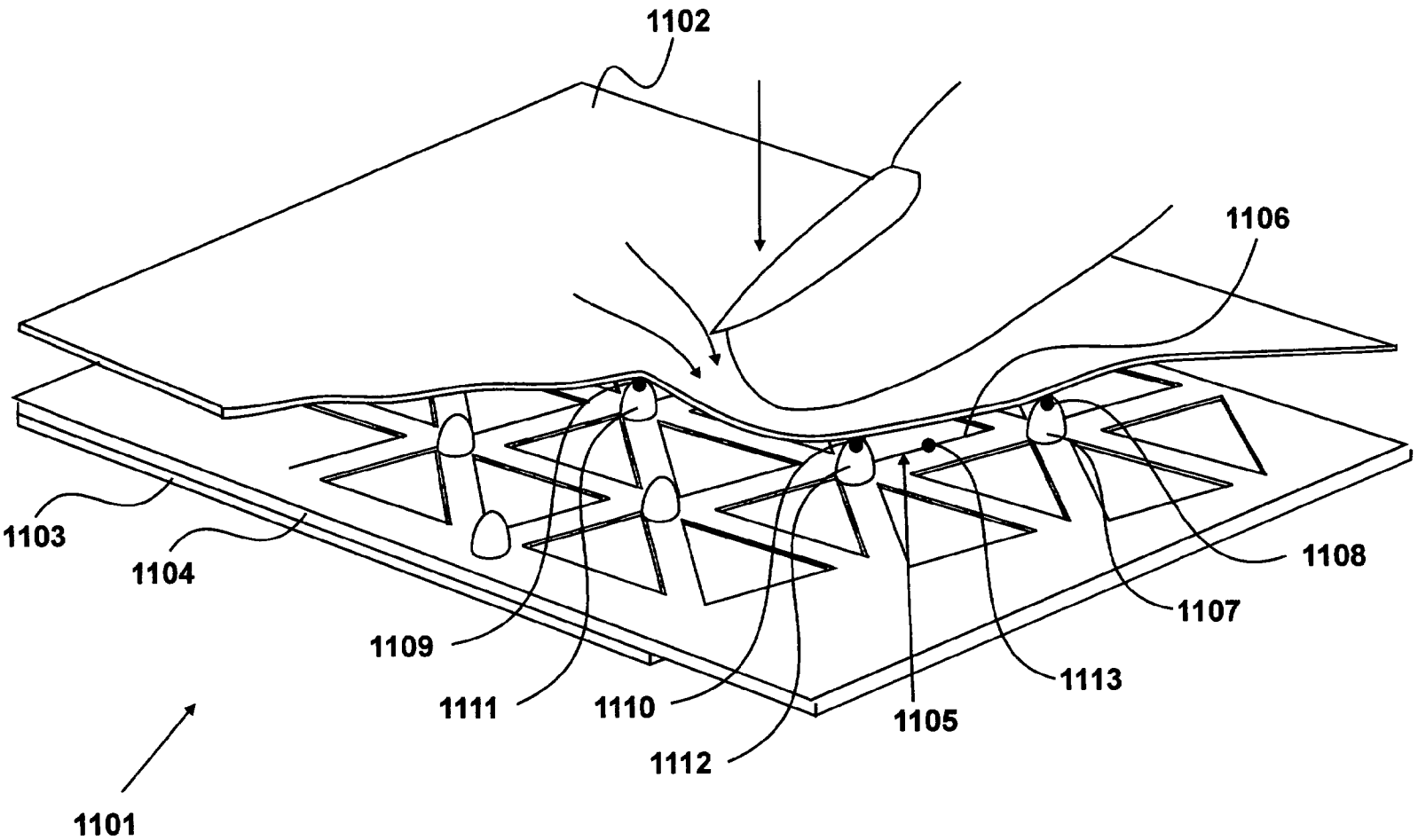
FIG. 11 shows deformation of a layer of a sensor.

FIG. 11 illustrates deformation of a layer of a sensor 1101 constructed from a first conductive knitted textile layer 1102, a second conductive textile layer 1103 and an intermediate separating mesh 1104 having extension portions only, during a mechanical interaction. Intermediate separating mesh 1004 defines a substantially triangular aperture 1005 having a structural perimeter 1106 and an extension portion 1107 having a structural endpoint 1108.

The intermediate separating mesh 1104 is oriented between the first conductive knitted textile layer 1102 and the second conductive textile layer 1103 such that the extension portions of the mesh point towards the first conductive knitted textile layer 1102. In the rest condition of the sensor 1101, the first conductive knitted textile layer 1102 rests upon the extension portions of the intermediate separating mesh 1104; the structural endpoints of the extension portions support the first conductive knitted textile layer 1102 in a spaced apart condition.

As shown, when pressure is applied to the first conductive knitted textile layer 1102 at a location between extension portions, the first conductive knitted textile layer 1102 deforms towards the second conductive textile layer 1102. It can be seen that the first conductive knitted textile layer 1102 deforms from structural endpoints of extension portions surrounding the point of applied pressure, such as structural endpoints 1108, 1109 and 1110 of extension portions 1107, 1111 and 1112 respectively. When the first conductive knitted textile layer 1102 reaches an aperture in the mesh 1101, such as aperture 1105, the first conductive knitted textile layer 1102 deforms into the aperture from structural endpoints around the structural perimeter of the aperture, such as endpoint 1113 of aperture 1105.

Thus, when an intermediate separating mesh with extension portions is utilised in the construction of a three layer sensor, two stage deformation of one outer conductive textile layer towards the other can occur; a first stage of deformation from the structural endpoints of the extension portions and a second stage of deformation from the structural endpoints of the apertures.

Thus, a mesh having extension portions can be considered as being three-dimensional compared to a mesh that is not provided with extension portions, which then may be considered as two-dimensional.

The provision of extension portions on a mesh further displaces the first conducting layer from the second conducting layer, with the effect being to reduce the occurrence of false triggering. The provision of these extension portions is particularly effective at reducing the occurrences of false triggering caused by undulations or creases in the sensor or cover. However, the area of mesh covered by these extension portions is relatively small therefore they do not add significantly to the actual thickness of the mesh over the majority of the mesh surface. It can be seen from FIG. 11 that as that the first conductive knitted textile layer 1102 deforms from structural endpoints of extension portions, the deformation of the layer radiates outwardly from the location of applied pressure and between and beyond extension portions around the location of applied pressure. Consequently, the additional resistance provided to intentional mechanical interactions is minimal. Thus, the provision of the extension portions reduces the extent of false triggering while at the same time providing little further resistance to intended layer interaction.

FIG. 12

Figure 12:
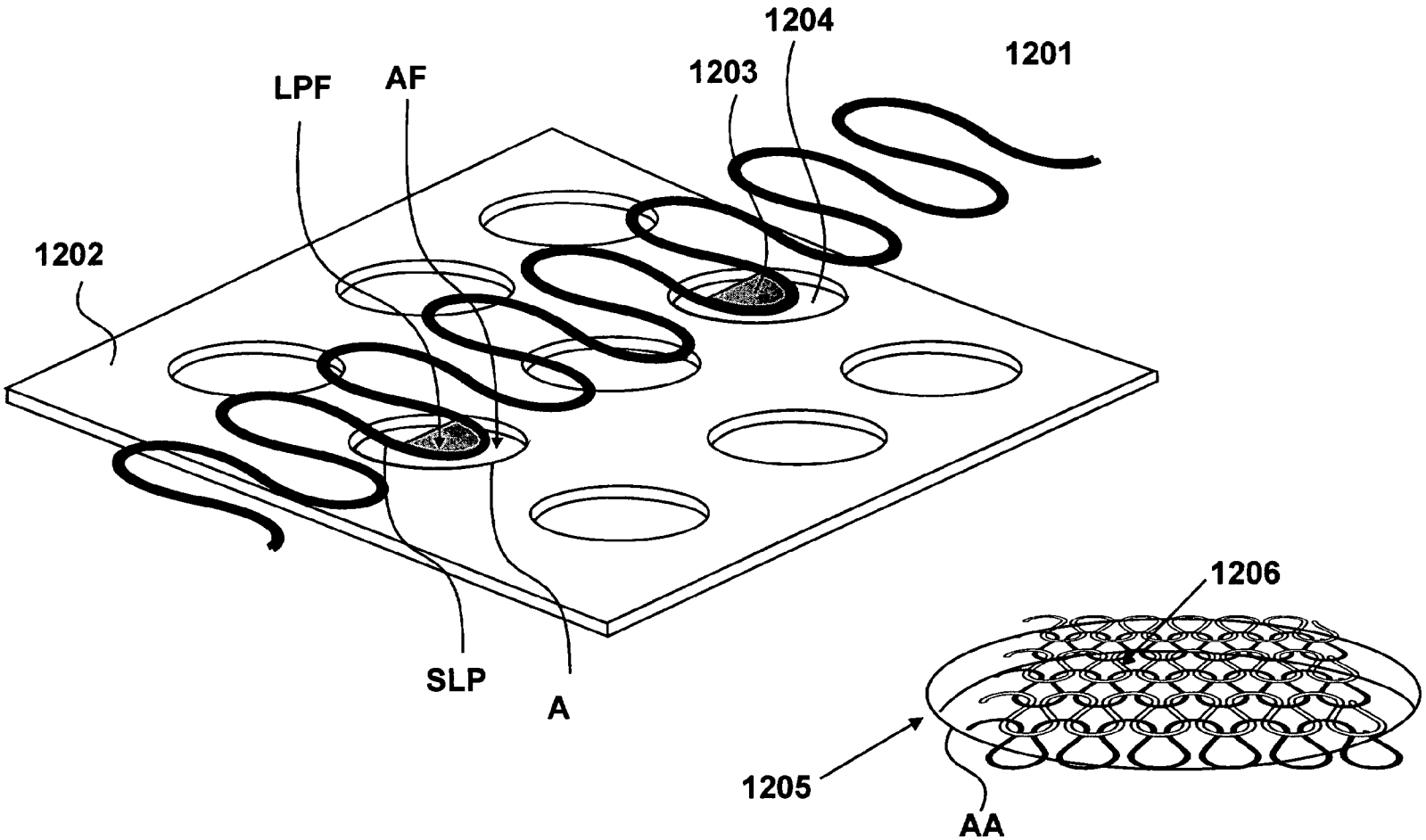
FIG. 12 illustrates a first dimensional relationship between features of layers of a sensor.

FIG. 12 shows a conductive yarn 1201 of a knitted conductive textile layer overlying an intermediate separating layer 1202 of a sensor featuring an aspect of the present invention. The conductive yarn 1201 is knitted to form a repeating pattern of stitches comprising a stitch looping portion SLP having a looping portion footprint LPF.

The intermediate separating layer 1202 defines a plurality of apertures A having an aperture footprint AF. Intermediate separating layer 1202 is not provided with any extension portions.

As shown, the looping portion footprint LPF of stitch looping portion SLP is wholly containable within aperture footprint AF. It can be seen that yarn 1201 is positioned relative to separating mesh 1202 such that a looping portion of a stitch extends within and across but not beyond the bounds of an aperture, for example, looping portion 1203 aligned with aperture 1204. This condition of a stitch looping portion aligned with an aperture is herein referred to as loop-aperture alignment.

Conductive yarn 1201 of the knitted conductive textile layer is readily deformed at a stitch looping portion. Such deformation is repeatable and controllable, due to the physical characteristics of the loop acting as a small paddle or lever. A loop can be viewed as being able to pivot downwards, from where it extends from a previous interlaced loop.

It is preferable, as shown at 1205, to make available a plurality of loops to an aperture AA, to increase the number of loops available to deform into the aperture under applied pressure. At 1205, a knitted textile 1206 forming a conductive layer of a sensor is shown. The stitches of the knit of textile 1206 are of a comparatively small size with respect to the dimensions of aperture AA such that an array of loops occurs aligned with the aperture AA. This increases the uniformity of response of a sensor, by making available more loops able to deform under manually applied pressure. This increases the incidence of the desired reaction to pressure applied at the location of the aperture, with less dependency on the exact point of application and direction in which the pressure is applied.

It is desirable to manufacture the sensor to a specification that ensures loop-aperture alignment of a plurality of stitch looping portions with each aperture of the intermediate separating layer. Within a sensor, the practical maximum number of looping portions in loop-aperture alignment with a single aperture of the intermediate separating layer may vary according to the distance between the first knitted conductive textile layer and the second textile layer, and the compliance of the first knitted conductive textile layer.

FIG. 13

Figure 13:
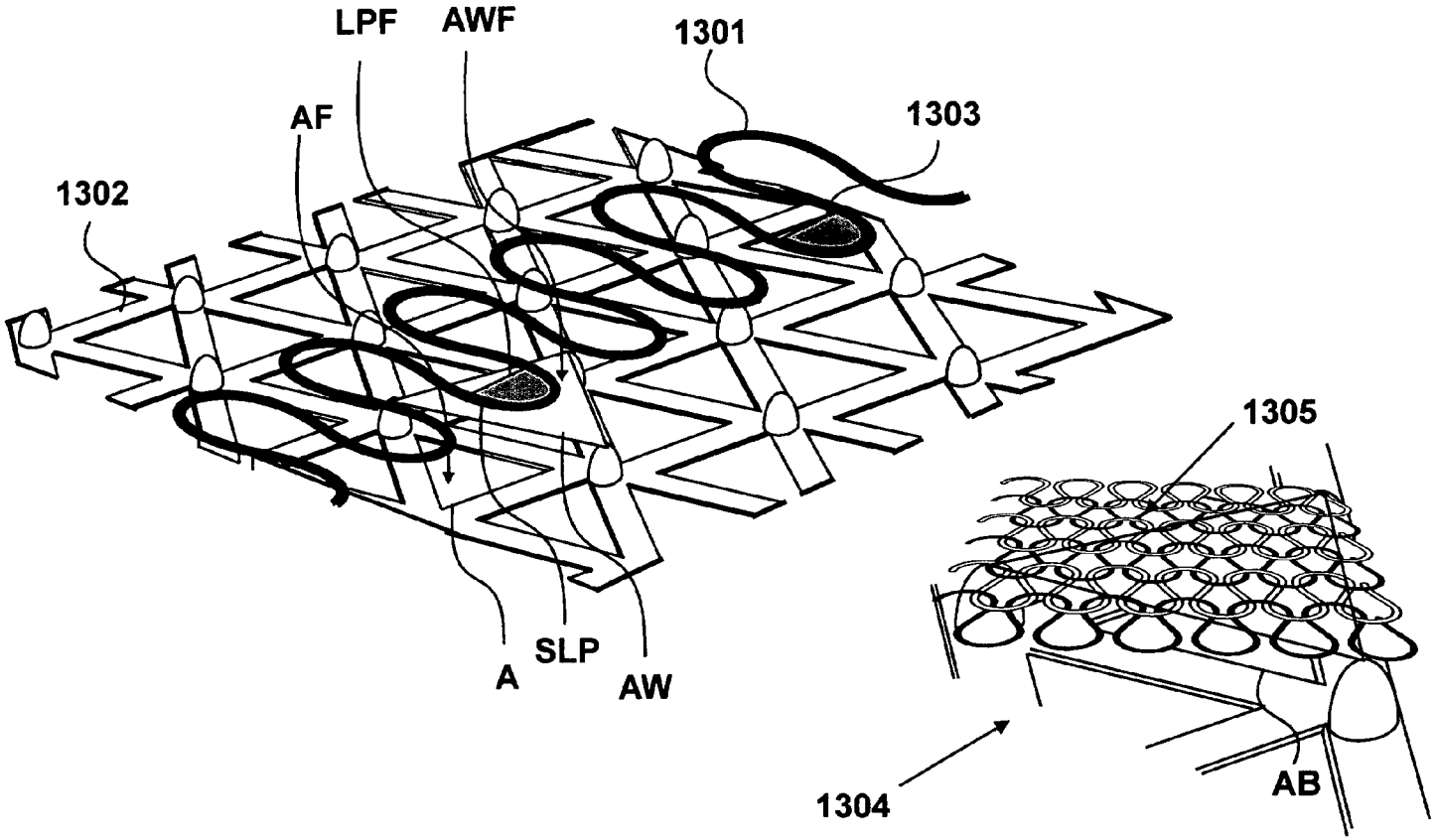
FIG. 13 illustrates a second dimensional relationship between features of layers of a sensor.

FIG. 13 shows a conductive yarn 1301 of a knitted conductive textile layer overlying an intermediate separating layer 1301 of a sensor featuring an aspect of the present invention. The conductive yarn 1301 is knitted to form a repeating pattern of stitches comprising a stitch looping portion SLP having a looping portion footprint LPF.

The intermediate separating layer 1302 defines a plurality of apertures A having an aperture footprint AF. Intermediate separating layer 1302 is provided with extension portions defining a virtual polygonal aperture window AW having an aperture window footprint AWF.

As can be seen from FIG. 13, the looping portion footprint LPF of stitch looping portion SLP is wholly containable within aperture window footprint AWF. Loop-aperture window alignment is shown at 1303.

As shown at 1304, it is preferable to make available a plurality of loops to an aperture AB. At 1304, a knitted textile 1305 forming a conductive layer of a sensor is shown. The stitches of the knit of textile 1305 are of a comparatively small size with respect to the dimensions of aperture AB such that an array of loops occurs aligned with the aperture AB.

Thus, with a sensor utilising an intermediate separating layer defining apertures and having extension portions there may be both loop-aperture window alignment and loop-aperture alignment.

FIG. 14

Figure 14:
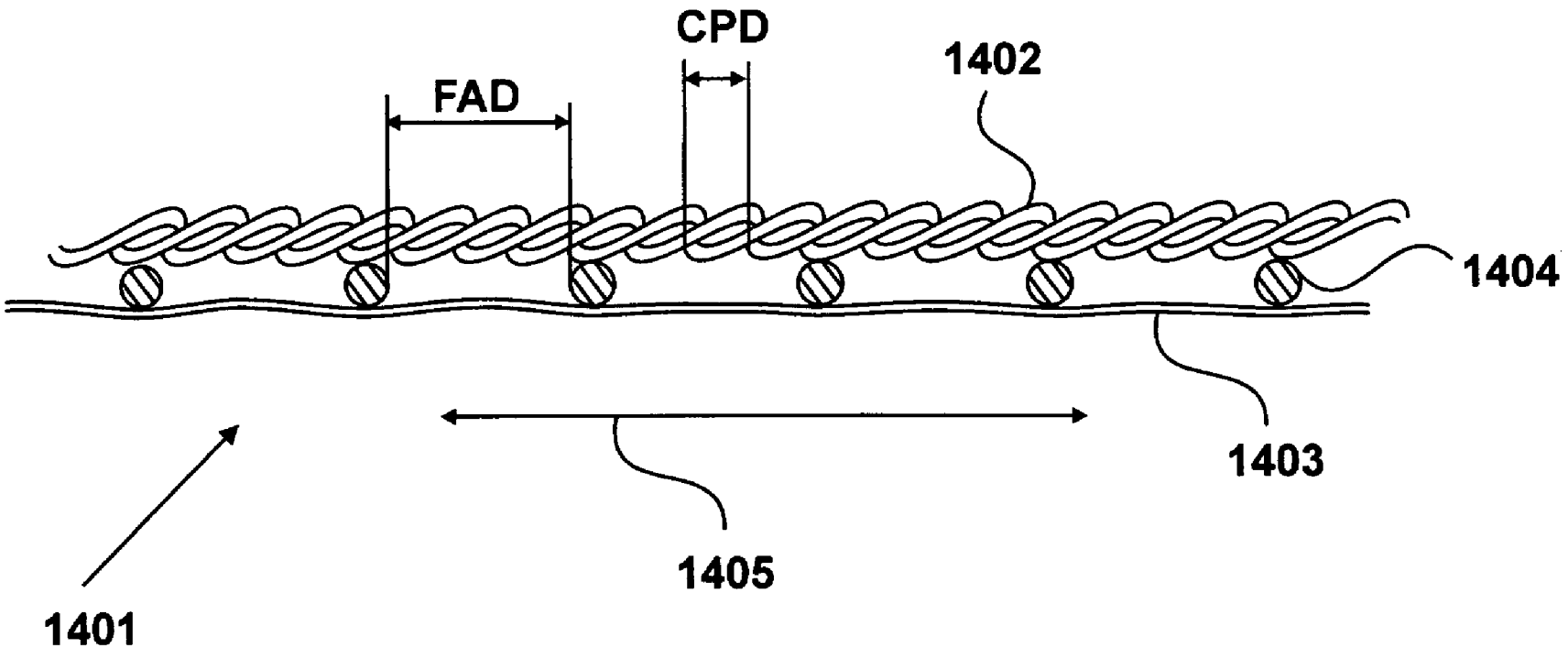
FIG. 14 illustrates a third dimensional relationship between features of layers of a sensor.

FIG. 14 shows a cross-section of a sensor 1401 featuring an aspect of the present invention, constructed from three layers only; a first knitted conductive textile layer 1402, a second conductive textile layer 1403 and an intermediate separating layer 1404 disposed between the first and second conductive textile layer. The intermediate separating layer 1404 defines a plurality of apertures.

The first knitted conductive textile layer 1402 includes conductive yarn knitted to form a repeating pattern of stitches.

Sensor 1402 incorporates a first dimensional relationship between these stitches of the first knitted conductive textile layer 1402 and the apertures of the intermediate separating layer 1404. This first dimensional relationship facilitates uniform deformation of layer 1402 through apertures in 1404 upon the application of pressure.

FIG. 14 shows a row of courses of the first knitted conductive textile layer 1402, having a course pitch dimension CPD, occurring in a first direction indicated by arrow 1405. Intermediate separating layer 1404 has a first aperture dimension FAD that is the distance across an aperture measured in the same first direction indicated by arrow 1405. The course pitch dimension CPD of first knitted conductive textile layer 1402 is smaller than the first aperture dimension FAD of intermediate separating layer 1404.

In addition to or alternatively, sensor 1402 may incorporate a second dimensional relationship between stitches of the first knitted conductive textile layer 1402 and the apertures of the intermediate separating layer 1404. Wales of first knitted conductive textile layer 1402 extend in a second direction that is orthogonal to the first direction indicated by arrow 1405. Intermediate separating layer 1404 has a second aperture dimension SAD that is the distance across an aperture measured in this second direction. According to the second dimensional relationship, the wale pitch dimension WPD of first knitted conductive textile layer 1402 is smaller than the second aperture dimension SAD of intermediate separating layer 1404. This second dimensional relationship facilitates uniform deformation of layer 1402 through apertures in 1404 upon the application of pressure.

FIG. 15

Figure 15:
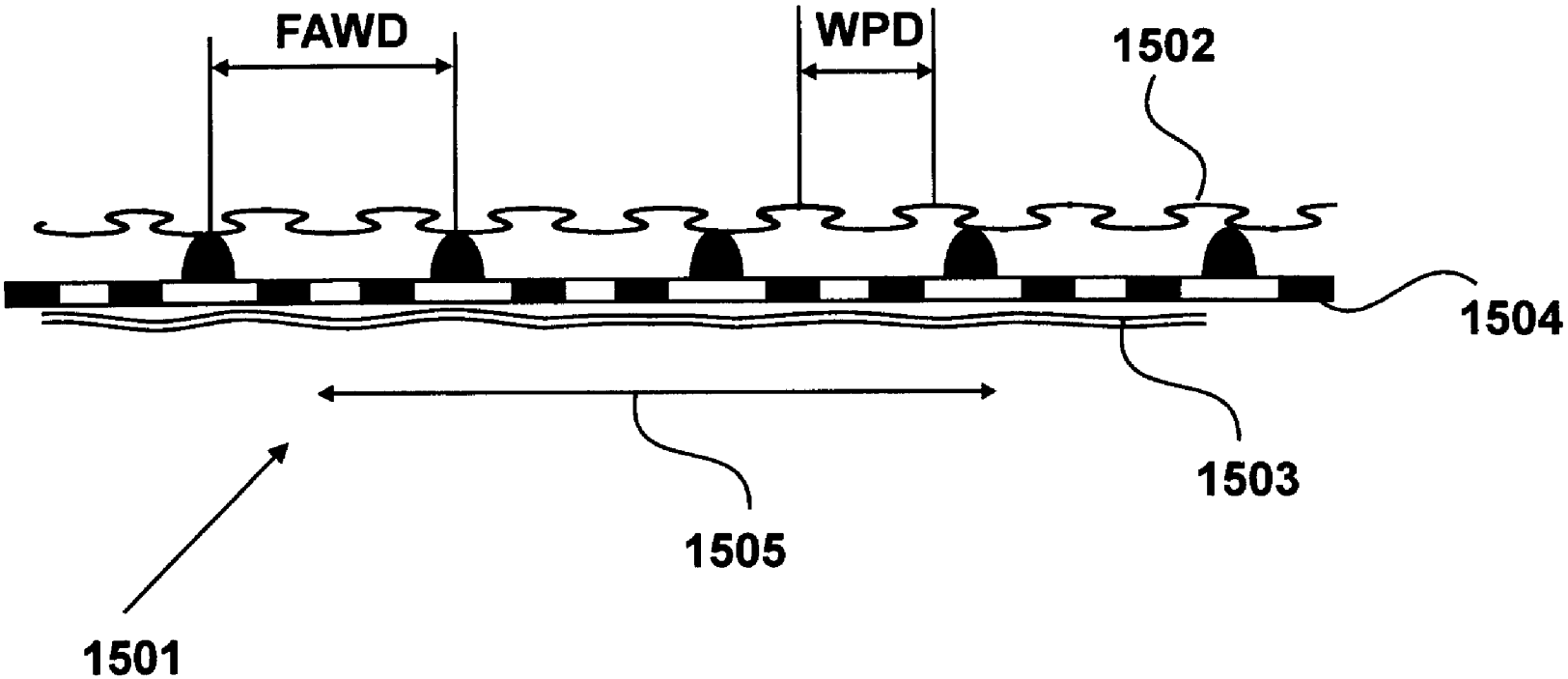
FIG. 15 illustrates a fourth dimensional relationship between features of layers of a sensor.

FIG. 15 shows a cross-section through a sensor 1501 featuring an aspect of the present invention, constructed from three layers only; a first knitted conductive textile layer 1502, a second conductive textile layer 1503 and an intermediate separating layer 1504 disposed between the first and second conductive textile layer. The intermediate separating layer 1504 defines a plurality of apertures and has extension portions.

Sensor 1502 incorporates at least one dimensional relationship between stitches of conductive yarn of the first knitted conductive textile layer 1502 and the aperture windows of the intermediate separating layer 1504.

FIG. 15 shows a row of wales of the first knitted conductive textile layer 1502, having a wale pitch dimension WPD, occurring in a first direction indicated by arrow 1505. Intermediate separating layer 1505 has a first aperture window dimension FAWD that is the distance across an aperture window measured in the same first direction indicated by arrow 1505. The wale pitch dimension WPD of first knitted conductive textile layer 1502 is smaller than the first aperture window dimension FAWD of intermediate separating layer 1504.

In addition to or alternatively, sensor 1502 may incorporate a second dimensional relationship between stitches of the first knitted conductive textile layer 1502 and the aperture windows of the intermediate separating layer 1504. Courses of first knitted conductive textile layer 1502 extend in a second direction that is orthogonal to the first direction indicated by arrow 1505. Intermediate separating layer 1504 has a second aperture window dimension SAWD that is the distance across an aperture window measured in this second direction. According to the second dimensional relationship, the course pitch dimension CPD of first knitted conductive textile layer 1502 is smaller than the second aperture window dimension SAWD of intermediate separating layer 1504.

Thus, a sensor may feature a looping portion footprint LPF of a first knitted conductive textile layer that is wholly containable within an aperture footprint AF or aperture window footprint AWF of an intermediate separating layer. In addition to or in the alternative, a sensor may feature a stitch pitch dimension of a first knitted conductive textile layer measured in a first direction that is smaller than either a first aperture dimension FAD or a first aperture window dimension FAWD measured in the same first direction.

FIG. 16

Figure 16:
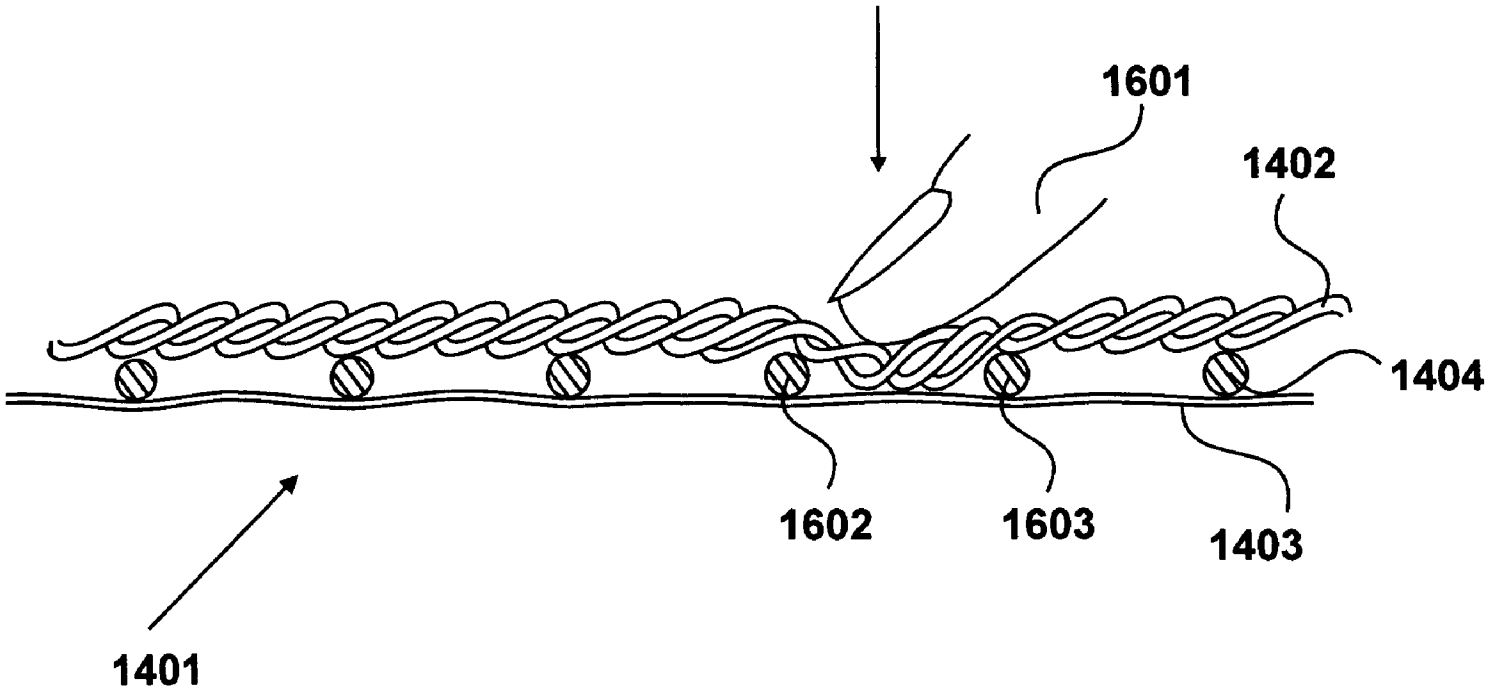
FIG. 16 shows the sensor of FIG. 14 responding to manually applied pressure.

FIG. 16 shows sensor 1401 of FIG. 14 responding to manually applied pressure. A finger 1601 is shown pressing the first knitted conductive textile layer 1402 at a location between two supporting portions 1602, 1603 of the intermediate separating layer 1404. It can be seen that the first knitted conductive textile layer 1402 deforms under this mechanical interaction such that several stitches collapse into the aperture of the intermediate separating layer 1404 towards the second conductive textile layer 1403 to make electrical contact.

The incorporation into a sensor of at least one of the dimensional relationships between a first knitted conductive textile layer and an intermediate separating layer previously described imparts to the sensor an improved uniformity of sensitivity. The provision of sufficient looping portions within a knitted conductive textile layer to provide loop-aperture or loop-aperture window alignment for each aperture or aperture window respectively of the intermediate separating layer provides for improved uniformity of collapse of the first knitted conductive textile layer across the sensor in response to applied pressure.

Referring back to FIG. 12, not all of the stitch looping portions of a conductive layer align with mesh apertures. This structural feature may introduce non-uniformity into the response of a sensor to applied pressure.

It is preferable to align the first knitted conductive textile plane or layer with the intermediate separating plane or layer of the sensor to ensure an appropriate degree of loop-aperture alignment. This feature serves to provide a greater degree of consistency of sensor response. Alignment may be performed between two separate layers or two planes may be manufactured into a single layer or structure, the latter being advantageous since more precise alignment can be achieved by manufacturing the planes in accordance with a pattern designed to provide this quality. For example, the intermediate separating plane may be provided in the form of a textile structure and the intermediate separating plane and the first knitted conductive textile layer may be machined together to form a textile structure incorporating a predetermined loop-aperture window alignment pattern.

FIG. 17

Figure 17:
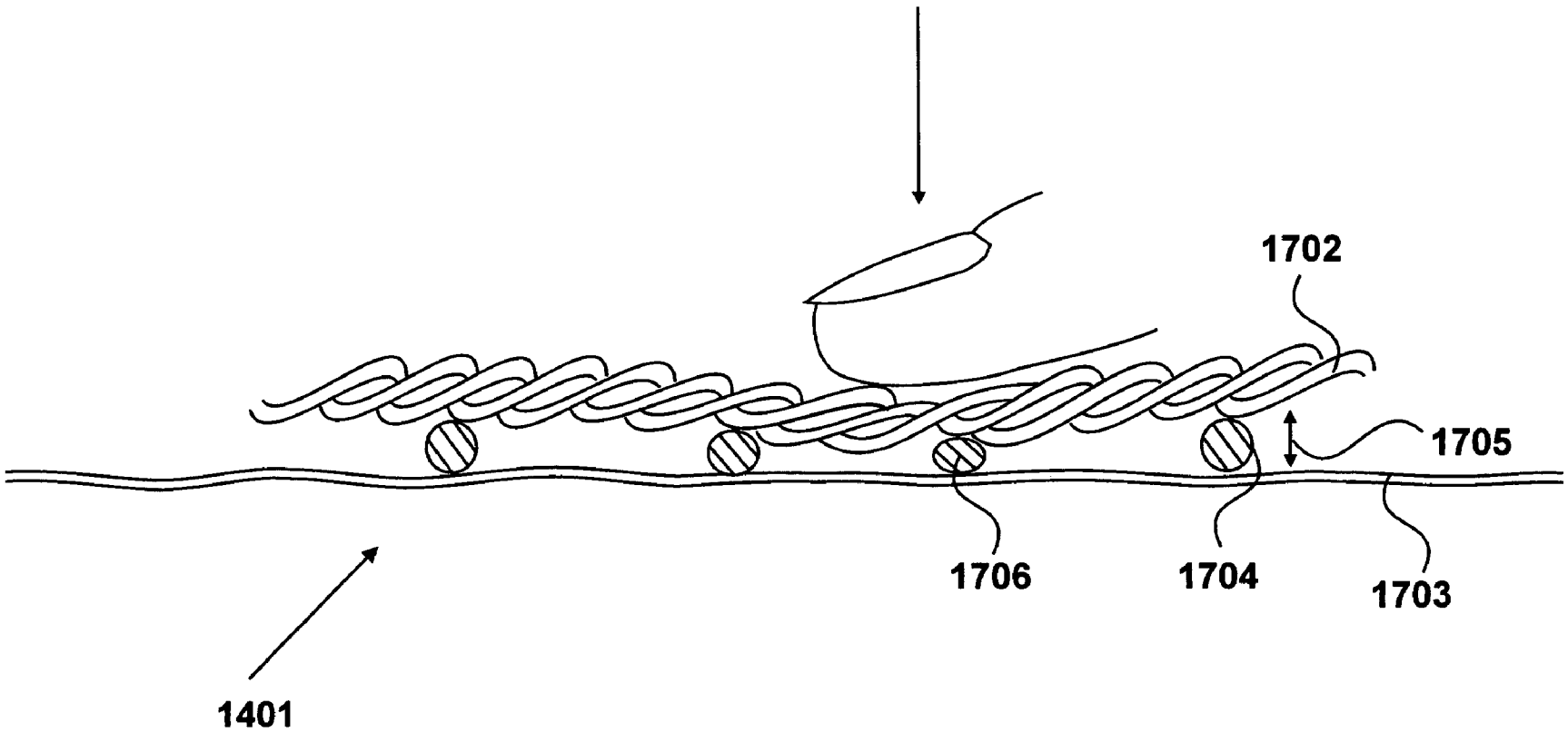
FIG. 17 shows a cross section of a sensor.

FIG. 17 shows a cross-section through a sensor 1701 constructed from three layers only; a first knitted conductive textile layer 1702, a second conductive textile layer 1703 and an intermediate separating layer 1704 disposed between the first and second conductive textile layer.

Intermediate separating layer 1702 is compliant in the direction indicated by arrow 1705 i.e. in the direction orthogonal to the plane of the sensor 1701. Thus, as shown, when pressure is applied to bring first knitted conductive textile layer 1702 into contact with second conductive textile layer 1703, supporting portions of the intermediate separating layer about the press location, for example supporting portion 1706, undergo compression. This squeezing of the intermediate separating layer functions to reduce the distance between the planes of the outer layers 1702, 1703. However, the resilience of the mesh returns the gap between the conductive textile layers to the distance of that in the at rest condition of the sensor when the applied pressure is removed.

A compressible intermediate separating plane may be fabricated from a resilient material, such as elastomeric silicone polymer, having a hardness of 15-20 Shore A.

Figure 18A:
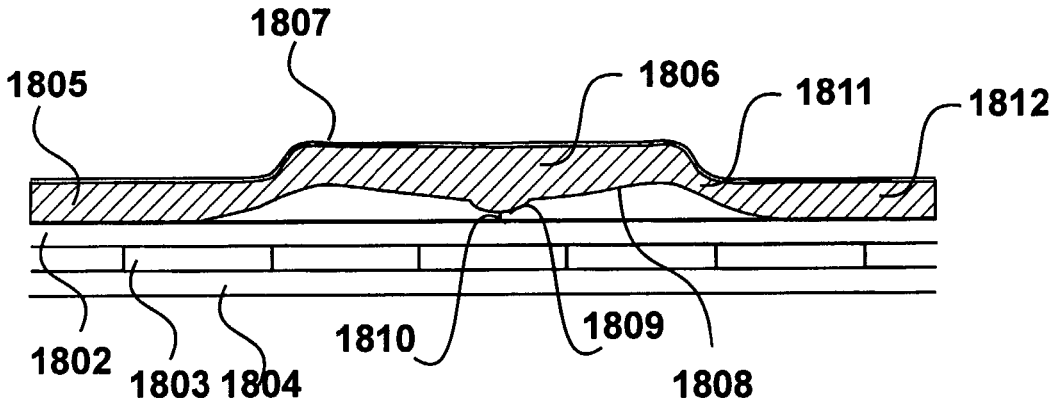
FIGS. 18A and 18B show a force concentration device of a sensor.
Figure 18B:
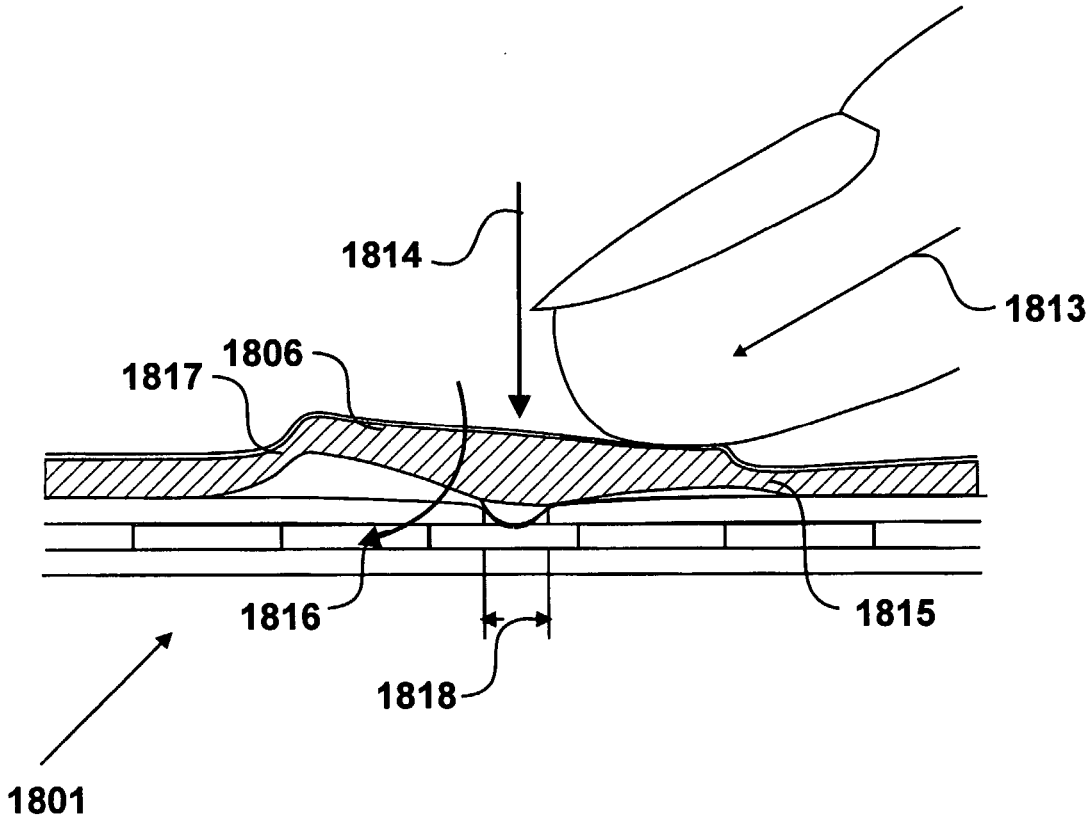

FIGS. 18A and 18B

A sensor may be provided with a force concentration device, to focus and localise the area of application of an applied force to thereby increase the pressure applied to the detector. The inclusion of a force concentration device allows a denser intermediate separating layer to be used. The combination of a force concentration device with a denser separating layer structure ensures that the detector is sufficiently sensitive to tactile mechanical interactions while at the same time it is substantially more resilient to false triggering caused by, for example flexing of the detector. The inclusion of a force concentration device may also allow a thicker intermediate separating layer to be used.

FIG. 18A and FIG. 18B each show a cross-section through a sensor 1801 constructed from three layers only; a first knitted conductive textile layer 1802, a second conductive textile layer 1803 and an intermediate separating textile layer 1804 disposed between the first and second conductive textile layer. In addition, sensor 1801 is provided with an outer key layer 1805 defining key positions.

The key positions of the key layer 1805 include an upper portion 1806 having an upper surface 1807 and a lower surface 1808. The upper surface 1807 supports the application of a finger and to assist in this operation, the upper surface 1807 optionally presents a slightly concave profile to the approaching finger.

A contact position 1808 extends from the lower surface 1808 to the upper portion 1806 and as such provides a force concentration device for localising the area of application of an applied force. FIG. 18A shows the key layer 1805 in the rest condition. When not under pressure, the contact portion 1809 is displaced from the position detector by a displacement of preferably 0.2 mm, as illustrated by arrow 1810. In alternative embodiments, this distance may be changed to displacements of say, between zero and 0.8 mm. A displacement of between 0.1 and 0.3 mm is considered to be preferred.

Wall portions 1811 extend between support region 1812 and the upper portion 1806. The wall portions under region 1812 of the upper portion surrounding the contact portion 1809 have a reduced thickness. The reduced thickness is provided so as to enhance collapsibility when a finger press is displaced from its preferred central location.

The effects of the key shown in FIG. 18A being pressed are illustrated in FIG. 18B. Finger pressure is applied in a direction identified by arrow 1813, in this example this is offset from an optimum central position of the upper portion 1806 as identified by arrow 1814. Under these conditions, a near wall portion 1815 collapses and the upper portion 1806 rotates as illustrated by arrow 1816, with respect to a far wall portion 1817. As this rotation takes place, the contact position 1808 applies contact force to the sensor over a contact region 1818.

A sensor may thus be provided with a layer that has a force concentration device on the underside. According to the example of FIGS. 18A and 18B, the force concentrating device is provided on the underside on an additional, and in this case overlying, layer. In alternative applications, a force concentrating device may be provided on the underside of a first knitted conductive textile layer.

The size, shape, location and orientation of a force concentrating device used in a sensor and the profile of the contact portion can be optimised for specific applications.

FIG. 19

Figure 19:
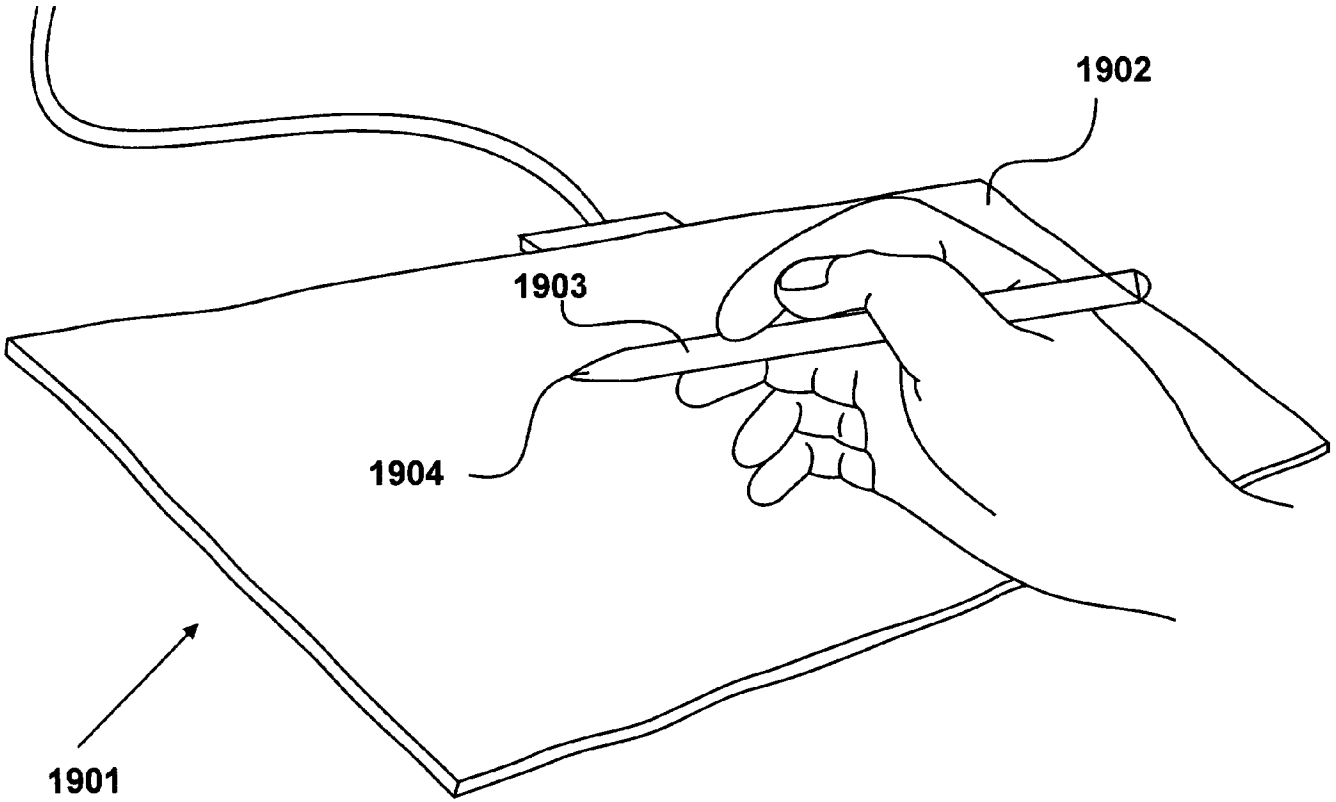
FIG. 19 shows a force concentration device.

An assembled flexible sensor 1901 is shown in FIG. 19. The flexible sensor 1901 is provided with a protective cover 1902 that overlies the first knitted conductive textile layer of the sensor. Flexible sensor 1901 is configured to determine the position of a mechanical interaction within a sensing area (X-axis and Y-axis data) and to detect an additional property of the mechanical interaction, for example pressure (Z-axis data).

A force concentration device is provided in the form of a stylus 1903. The stylus 1903 has a stylus tip 1904 such that force applied to the stylus during manual operation by a user results in this force being concentrated at the tip 1904 of the stylus 1903.

The use of a force concentration device with the same force as would otherwise be used with a direct contact increases the likelihood of recognition of a mechanical interaction. Therefore, in some applications, the likelihood of recognition of a mechanical interaction made using a force concentration device with less force than would otherwise be used may be increased.

FIG. 20

The uniformity of response of a sensor may be improved by utilising compliant yarns within the construction of at least the first knitted conductive textile layer of the sensor.

Figure 20:
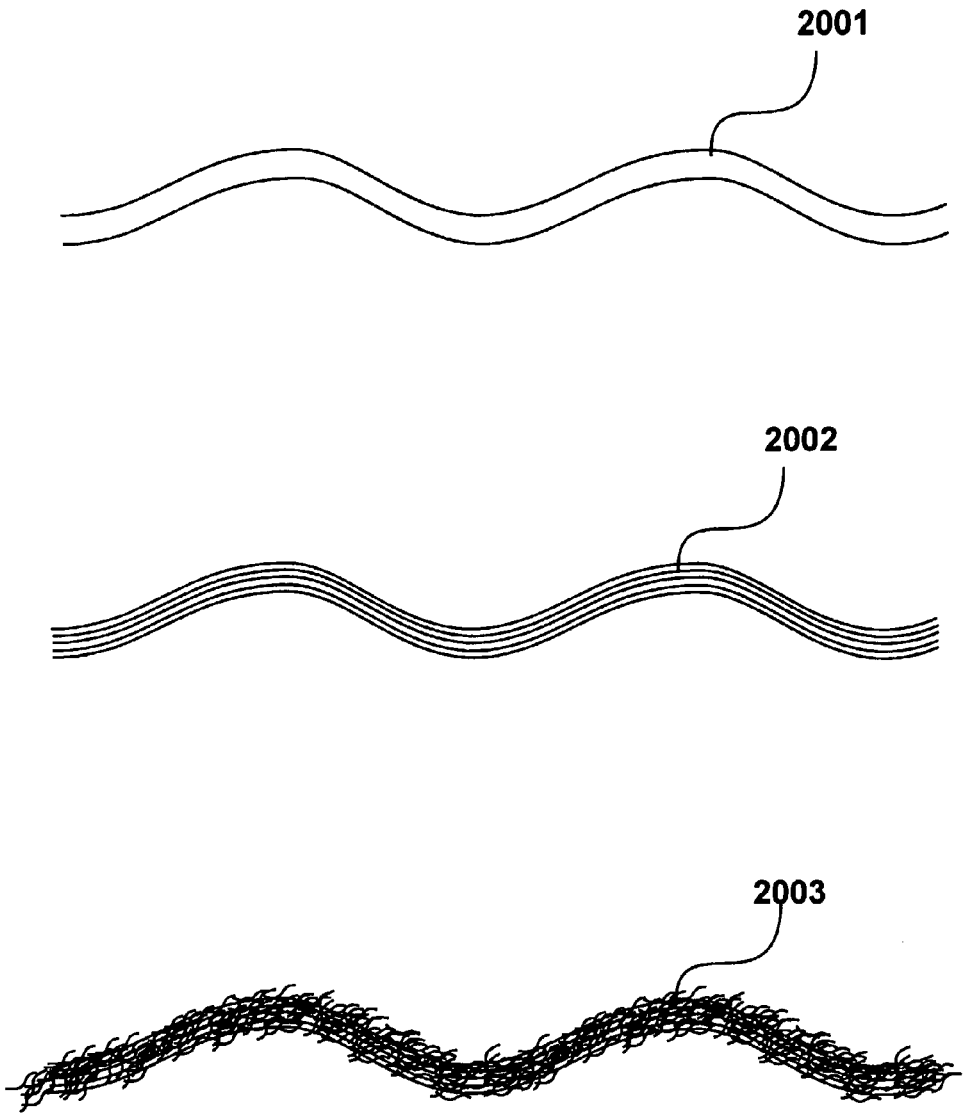
FIG. 20 shows different types of yarn.

FIG. 20 shows three yarns 2001, 2002 and 2003. First non-compliant yarn 2001 is a monofilament yarn, whereas first compliant yarn 2002 is a multifilament yarn. Multifilament yarns have a degree of inherent compliance however, the compliance thereof can be improved by the inclusion of elastic yarns, for example Lycra TM or Elastane TM. First compliant yarn 2002 is an untwisted multifilament yarn, however multifilament yarns are typically twisted, and the twisted type of multifilament yarn is considered to provide an equal or improved performance.

Second compliant yarn 2003 is a textured yarn. Such yarns are typically used to provide additional softness and compliance to enhance the feel of a fabric. Different processes may be used to produce textured yarn including processes utilising air jets during yarn cooling, or processes in which twisting, heating and untwisting of a multifilament yarn is performed. Irrespective of the manufacture process, the textured yarn is "fluffy". The additional compliance introduced by using textured yarn in a first knitted conductive textile plane provides a more controlled collapse of the plane under applied pressure. This further improves the uniformity of sensitivity, and provides a sufficiently sensitive response to applied pressure.

Considering the second conductive textile layer, the layer may take the form of a woven fabric constructed using yarns with significant inherent elasticity. Thus, a degree of compliance of the layer may be provided by the elasticity of the yarn itself. Alternatively, for example, the layer may take the form of a warp knit constructed using non elastic yarns such that the compliance of the layer is provided by the nature of the fabricated material.

The invention claimed is:

1. A sensor comprising:

a first knitted conductive textile plane, a second conductive textile plane, and an intermediate separating plane penetrable by the first knitted conductive textile plane to allow the first conductive textile plane and the second conductive textile plane to make electrical contact under a mechanical interaction;

the intermediate separating plane defines the structural perimeter of each of a plurality of apertures from which the first knitted conductive textile plane deforms towards the second conductive textile plane under a mechanical interaction; wherein:

the first knitted conductive textile plane has conductive yam knitted to form a repeating pattern of stitches each comprising a stitch looping portion SLIP having a looping portion footprint LPF, the separating plane defines apertures A having an aperture footprint AF, at least one looping portion footprint LPF is wholly containable within at least one aperture footprint AF; and said intermediate separating plane is provided in the form of a textile structure and said intermediate separating plane and said first knitted conductive textile layer are machined together to form a textile structure incorporating a predetermined loop-aperture alignment pattern.

2. A sensor according to claim 1, wherein:

the first knitted conductive textile plane has conductive yarn knitted to form a repeating pattern of stitches comprising a wale pitch dimension WPD occurring in a first direction and a course pitch dimension CPD occurring in a second direction, the separating plane has apertures having a first aperture dimension FAD measured in said first direction and a second aperture dimension SAD measured in said second direction, and at least one of said wale pitch dimension WPD and said course pitch dimension CPD is smaller than at least one of said first aperture dimension FAD and/or second aperture dimension SAD.

3. A sensor according to claim 1, wherein said first knitted conductive textile plane said second conductive textile plane, and said intermediate separating plane are each provided in the form of a separate layer.

4. A sensor according to claim 1, wherein said predetermined loop-aperture alignment pattern incorporates loop-aperture alignment of a plurality of loops to an aperture.

5. A sensor according to claim 3, wherein said intermediate separating plane is provided in the form of a plastic mesh.

6. A sensor according to claim 3, wherein said intermediate separating plane is provided in the form of a compressible mesh.

7. A sensor according to claim 1, wherein said sensor is provided with a force concentration device comprising one of: a key position contact portion and a stylus.

8. A sensor according to claim 1, wherein said first knitted conductive textile plane includes at least one of: elastic yarn, textured yarn and multililament yarn.

* * * * *